US008649724B2

(12) United States Patent
Ziegelmuller et al.

(10) Patent No.: US 8,649,724 B2
(45) Date of Patent: Feb. 11, 2014

(54) CLEANING BLADE MEMBER AND APPARATUS WITH CONTROLLED TRIBOCHARGING

(75) Inventors: Francisco Luiz Ziegelmuller, Penfield, NY (US); Jean Marie Trost, Rochester, NY (US); James N. Alkins, Holley, NY (US); James Douglas Shifley, Spencerport, NY (US); Wayne Thomas Ferrar, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 111 days.

(21) Appl. No.: 13/117,174

(22) Filed: May 27, 2011

(65) Prior Publication Data

US 2012/0301197 A1 Nov. 29, 2012

(51) Int. Cl.
*G03G 21/00* (2006.01)

(52) U.S. Cl.
USPC ..... 399/350; 399/50

(58) Field of Classification Search
USPC ..... 399/350
See application file for complete search history.

(56) References Cited

U.S. PATENT DOCUMENTS

| | | | | |
|---|---|---|---|---|
| 4,123,269 | A * | 10/1978 | Von Hoene et al. | 430/60 |
| 4,675,262 | A * | 6/1987 | Tanaka | 430/58.05 |
| 5,153,657 | A * | 10/1992 | Yu et al. | 399/350 |
| 5,221,591 | A * | 6/1993 | Bugner et al. | 430/59.1 |
| 5,337,129 | A * | 8/1994 | Badesha | 399/308 |
| 5,363,182 | A | 11/1994 | Kuribayashi et al. | |
| 5,968,656 | A | 10/1999 | Ezenyilimba et al. | |
| 5,991,568 | A | 11/1999 | Ziegelmuller et al. | |
| 6,238,798 | B1 | 5/2001 | Kang et al. | |
| 6,453,134 | B1 | 9/2002 | Ziegelmuller et al. | |
| 2005/0214045 | A1 * | 9/2005 | Ohta et al. | 399/350 |
| 2006/0120773 | A1 * | 6/2006 | Itami et al. | 399/302 |
| 2011/0211883 | A1 | 9/2011 | Ferrar et al. | |

FOREIGN PATENT DOCUMENTS

JP 2000-066555 A * 3/2000 ..... G03G 21/10

OTHER PUBLICATIONS

Change in Indezing Policy for Siloxanes, (1/95), CAS, A Division of the American Chemical Society.

Kuniki Seine, et al., "Wear Characteristics and Cleaning Ability of Cleaning Blades", Journal of Imaging Science and Techanology, vol. 47, No. 5, Sep./Oct. 2003, pp. 424-433.

* cited by examiner

*Primary Examiner* — Clayton E Laballe
*Assistant Examiner* — Jas Sanghera
(74) *Attorney, Agent, or Firm* — David A. Novais

(57) ABSTRACT

A cleaning system has a composite photoreceptive imaging member having a support layer, an electrically conductive layer interfacing with the support layer, a photoconductive charge generation layer interfacing with the electrically conductive layer and generating charge holes and electrons in response to exposure to electromagnetic radiation; a charge transport layer that allows charge holes to migrate from the charge generation layer to the outer surface while resisting migration of electrons from the charge generation layer to the outer surface and a cleaning blade member having a cleaning surface layer against the electrostatic surface to at least in part remove toner and debris from the outer surface. The cleaning surface layer has a first material and a second material that are combined in proportions that cause a triboelectric charge to be formed on the outer surface having a difference of potential of between zero and minus 20 volts.

23 Claims, 18 Drawing Sheets

48

48

CLEANING BLADE MEMBER AND APPARATUS WITH CONTROLLED TRIBOCHARGING

FIELD OF THE INVENTION

This invention relates to cleaning systems of the type used, for example, in electrostatographic apparatus to remove toner, carrier particles, dust, lint, and paper debris from a moving surface that is typically in the form of an endless web or drum.

BACKGROUND OF THE INVENTION

The use of cleaning blades is widely practiced in electrostato-graphic printers and copiers for the removal of toner particles from various moving surfaces (Seino et al. *J. Imag. Sci. & Tech.* 2003, Vol. 47, 424). The portion of the cleaning blade that contacts the surface to be cleaned is generally a polyurethane because such polymers are durable and have a high degree of resilience that is well suited for making contact with a smooth surface.

The use of cleaning (wiper) blades for cleaning webs is described in U.S. Pat. No. 6,453,134 (Ziegelmuller et al.) where the cleaning blades are used to clean transport webs in electrophotographic printers. Toner patches are removed from the transport webs after image density is measured with some type of radiation such as a light emitting diode (LED).

The properties of such cleaning blades can be improved by surface coatings over the polyurethane. For example, U.S. Pat. No. 5,363,182 (Kuribayashi et al.) describes the use of a surface coating of graphite particles in a nylon resin. A primer layer is used to enhance the adhesion of the graphite-containing nylon resin to the polyurethane blade.

Urethane polymers that are designed to be hard like a ceramic yet flexible like a polymer are part of a group of materials known as ceramers. As discussed in U.S. Pat. No. 5,968,656 (Ezenyilimba et al.), ceramers are coated as layers of approximately 5 micrometers on relatively thick, resilient polyurethane substrates or cushion "blanket" cylinders to provide transfer of toner from a photoreceptor to a receiver in electrophotographic printers. One ceramer composition has a urethane backbone made from isophoronone diisocyanate and a polyether diol wherein the backbone is branched by the addition of trimethylolpropane and 1,4-butane diol serves as a chain extender, and the branched urethane is endcapped with 3-isocyanatopropyltriethoxysilane to provide alkoxysilane groups that can react with alkoxysilanes in a sol-gel reaction to form a polyurethane silicate hybrid organic-inorganic composite (OIC) network ceramer.

Urethane polymers containing fluorinated substituents are known. One mode of introduction of the fluorinated component is from a fluoroether, either as an endcapper or from the diol into the polyurethane backbone. U.S. Patent Application Publication 2007/0244289 (Tonge) describes a method of making urethane based fluorinated monomers that can be used to prepare radiation curable coating compositions, and discloses that such monomers can be used to formulate a ceramer composition such as disclosed in U.S. Pat. No. 6,238,798 (Kang et al.) that describes ceramer coating compositions comprising colloidal inorganic oxide particles and a free-radically curable binder precursor which comprises a fluorochemical component that further comprises at least two free-radically curable moieties and at least one fluorinated moiety. In such compositions, the colloidal inorganic oxide particles can be surface treated with a fluoro/silane component that comprises at least one hydrolysable silane moiety and at least one fluorinated moiety. As discussed therein, aggregation of the inorganic oxide particles in such compositions can result in precipitation of such particles or gelation of the ceramer composition, which, in turn, results in a dramatic, undesirable increase in viscosity.

Copending and commonly assigned U.S. Ser. No. 12/713,205 filed Feb. 26, 2010 by Ferrar, Rimai, Miskinis, and DeJesus describes cleaning blades having a polymer substrate and fluorinated polyurethane ceramer coatings that provide increased surface modulus with a low surface energy coatings. These improved cleaning blades represent an important advance in the development of cleaning systems, but there is a desire to further improve such cleaning systems.

Of particular interest is providing improved cleaning blades that can perform the cleaning function with minimal impact on the functionality and durability of the surface that is being cleaned by the cleaning blade. This is particularly important where the surface being cleaned is a primary imaging member of an electrophotographic printing system. Such a primary imaging member is designed and carefully manufactured to receive a generally uniform initial charge on an outer surface thereof, to selectively discharge initial charge to form an image modulated charge pattern when exposed to a pattern of light, to receive any toner that develops onto the outer surface in response to the charge pattern and to enable this toner pattern to be transferred intact onto a transfer member. Further, the primary imaging member also must be capable of being cleaned for example by a cleaning blade that scrapes or wipes toner and contaminant from the surface of the photoreceptor in a manner that enables the primary imaging member to repeat this cycle more than 100 times per minute for millions of cycles without perceptible degradation in function.

It will also be understood that while cleaning blades are primarily designed to provide effective cleaning of a primary imaging member it is also necessary that they do so while providing minimal interference with the functions of charging, selective discharging, and development. The cleaning blades further must perform the cleaning function in a manner that does not unduly reduce the number of cycles that a primary imaging member can be used.

For example, when a primary imaging member is cleaned by a cleaning blade, there is a risk that contact between the cleaning blade and the primary imaging member can create a charge on an outer surface of a primary imaging member because of the triboelectric effect. The triboelectric effect occurs where two materials are brought into contact that have, for example different electronegativity. In such a situation charge is transferred from one of the materials to the other.

The presence of a charge caused by the triboelectric effect can alter the charging and discharging properties of the primary imaging member. This creates areas of local charge variation that can prevent the primary imaging member from generating charge patterns that accurately reflect the imagewise exposure made on the photoconductor. Further, when an imagewise exposure of the photoreceptor to light occurs before the tribocharging induced charges are eliminated the tribocharging induced charges can be trapped in the primary imaging member in a way that cannot be eliminated.

Friction can also influence the performance of a primary imaging system and plays an important role in cleaning. When there is too much friction between a cleaning blade and the surface that the cleaning blade is cleaning, the cleaning blade can wear and heat the primary imaging member, as well as cause effects such as chatter, misregistration, and other effects known to those of skill in the art.

Two common types of friction reducing materials can be used to reduce friction between a cleaning blade and a surface that the blade is used to clean. The first type of friction reducing materials includes materials such as fluoropolymers such as Teflon. These materials are extremely electronegative and tend to charge primary imaging member positively when used as cleaning blades. The second type of friction reducing materials includes materials such as graphite whose crystal structure readily shears to reduce friction. However, materials such as graphite tend to be electrically conducting and can leave a conductive residue across portions of the surface being cleaned. The presence of such a conductive residue can interfere with charge patterns that must be provided on a primary imaging member to enable electrophotographic printing.

What is needed therefore is a cleaning system with controlled tribocharging and, optionally, controlled friction.

SUMMARY OF THE INVENTION

Cleaning systems are provided. In one aspect a cleaning system has a primary imaging member having a support, an electrically conductive layer interfacing with the support, a photoconductive charge generation layer interfacing with the electrically conductive layer and generating charge holes and electrons in response to exposure to electromagnetic radiation; a charge transport layer that allows charge holes to migrate from the charge generation layer to the outer surface while resisting migration of electrons from the charge generation layer to the outer surface; and, a cleaning blade member having a cleaning surface layer against the electrostatic surface to at least in part remove toner and debris from the outer surface. The cleaning surface layer has a first material and a second material that are combined in proportions that cause a triboelectric charge to be formed on the outer surface having a difference of potential of between zero and minus 20 volts to be generated between the outer surface and a ground.

In another aspect, a cleaning system has a primary imaging member having a support, an electrically conductive layer interfacing with the support, a photoconductive charge generation layer generating charge holes and electrons in response to exposure to electromagnetic radiation; a charge transport layer between the electrically conductive layer and the photoconductive charge generation layer that allows charge holes to migrate from the charge generation layer to the electrically conductive layer while resisting migration of charge holes from the charge generation layer to the outer surface; and a cleaning blade member having a cleaning surface layer in contact with the development surface. The cleaning surface layer has a first material and a second material that are combined in proportions that cause a triboelectric charge to be formed on the outer surface having a difference of potential of between zero and plus 20 volts to be generated between the outer surface and a ground.

DETAILED DESCRIPTION OF THE INVENTION

Definitions

As used herein, the term "ceramer" refers to a polyurethane silicate hybrid organic-inorganic network prepared by hydrolytic polymerization (sol-gel process) of a tetraalkoxysilane compound with alkoxysilane-containing organic moieties, which may be a trialkoxysilyl-terminated organic polymer. Further details of such materials are provided in *CAS Change in Indexing Policy for Siloxanes* (January 1995).

The term "fluoroceramer" refers to a material prepared similarly to a ceramer but reacting fluorinated polyurethane having terminal alkoxysilane moieties with a tetraalkoxysilane compound.

Unless otherwise indicated, the terms "cleaning blade member", "cleaning blade", or "blade" refer to embodiments of this invention.

The term "toner-carrying member" refers to a web, drum, belt, or any other component that transports or transfers toner particles or forms toner images using toner particles, or any component on which toner particle debris is found at any stage of an electrostatographic apparatus that uses toner particles to provide an image on a receiver element. For example, such toner-carrying members include but are not limited to, photoconductors, intermediate transfer members (webs or drums), receiver element transport member, and sheet-transfer web.

Unless otherwise indicated, the terms "cleaning blade" and "cleaning blade member" used in this invention include both "wiper blade" and "scraper blade" embodiments as these two terms have become used in the art, e.g. in U.S. Pat. No. 5,991,568 (Ziegelmuller et al.). Thus, the composition comprising a non-particulate, non-elastomeric ceramer or fluoroceramer and nanosized inorganic particles can be used in both wiper blades and scraper blades. See for example U.S. Pat.

No. 6,453,134 (noted above) for more details about wiper blades and U.S. Pat. No. 5,991,568 (noted above) for more details about both wiper and scraper blades.

Electrophotographic Printer and Cleaning System

Figure 1:
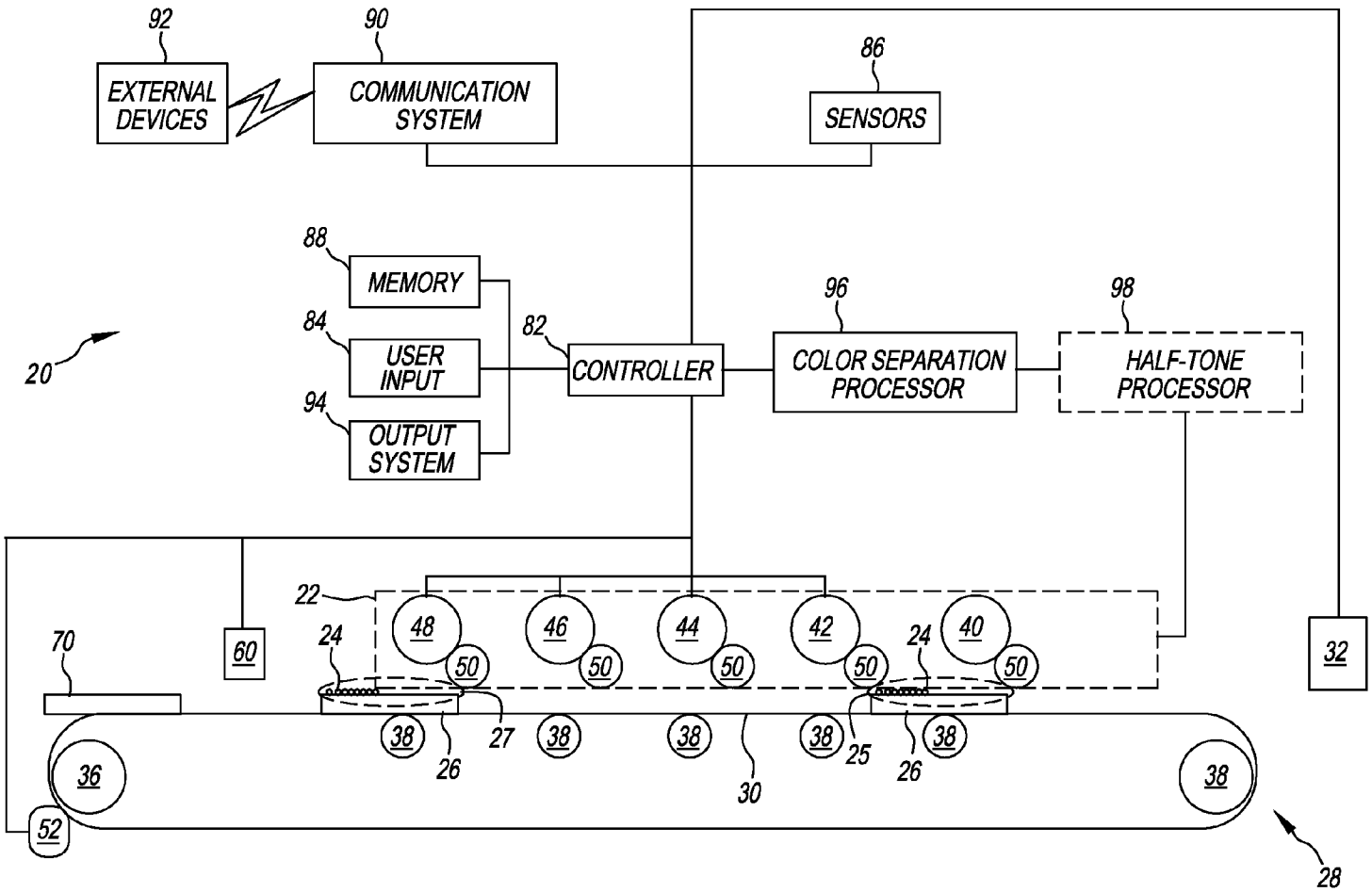
FIG. 1 is a system level illustration of a printer having a plurality of printing modules used to print onto a receiver.

FIG. 1 is a system level illustration of one embodiment of an electrophotographic printer 20. In the embodiment of FIG. 1, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26 to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Print engine 22 has one or more printing modules, shown in FIG. 1 as printing modules 40, 42, 44, 46, and 48 that are each used to deliver a single application of toner 24 to form a toner image 25 on receiver 26. For example, the toner image 25 shown formed on receiver 26 in FIG. 1 can provide a monochrome image or layer of a structure or other functional material or shape.

Print engine 22 and a receiver transport system 28 cooperate to deliver one or more toner image 25 in registration to form a composite toner image 27 such as the one shown in FIG. 1 as being formed on receiver 26. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26. That is, any of the five colors of toner 24 can be combined with toner 24 of one or more of the other colors at a particular location on receiver 26 to form a color after a fusing or fixing process that is different than the colors of the toners 24 applied at that location.

In FIG. 1 print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26 as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In operation, printer controller 82 causes one or more of individual printing modules 40, 42, 44, 46 and 48 to generate a toner image 25 of a single color of toner for transfer by respective transfer subsystems 50 to receiver 26 in registration to form a composite toner image 27. In an alternate embodiment, not shown, printing modules 40, 42, 44, 46 and 48 can each deliver a single application of toner 24 to a composite transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions and can be generated locally at a printer 20 or can be received by printer 20 from any of variety of sources including memory system 88 or communication system 90. In the embodiment of printer 20 that is illustrated in FIG. 1, printer controller 82 has a color separation image processor 96 to convert the image data into color separation images that can be used by printing modules 40-48 of print engine 22 to generate toner images. An optional half-tone processor 98 is also shown that can process the color separation images according to any half-tone screening requirements of print engine 22.

Figure 2:
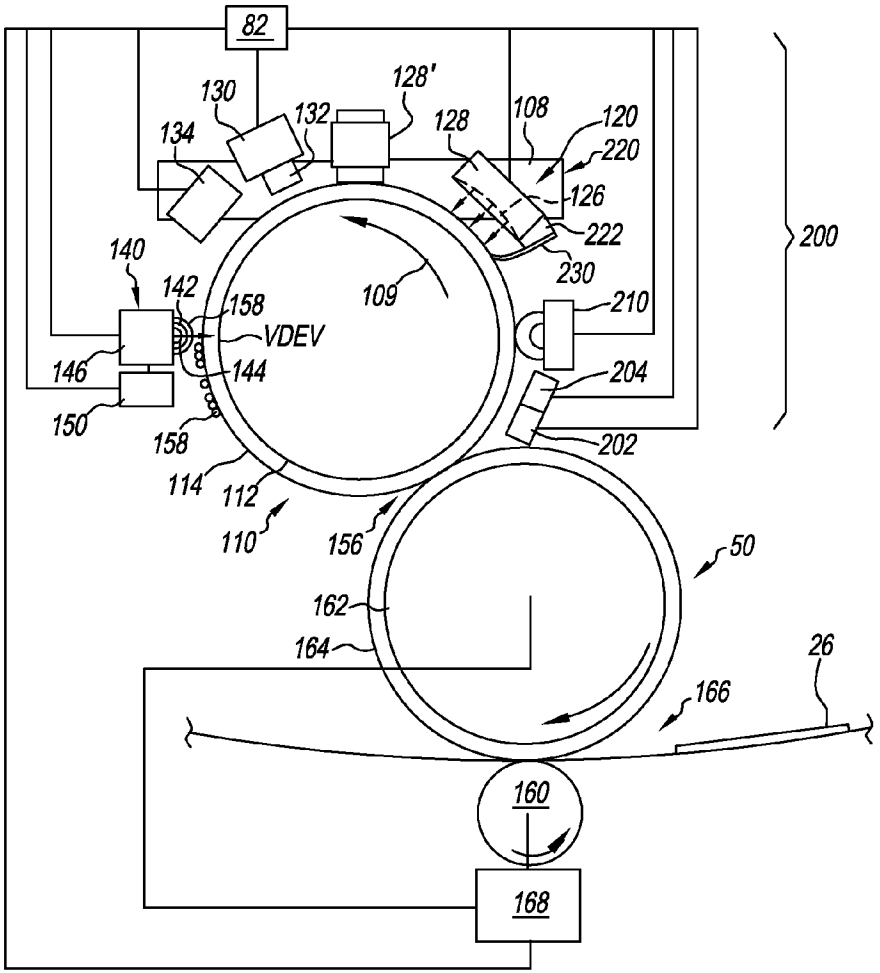
FIG. 2 shows a printing module of a type that can be used in the embodiment of FIG. 1 having an electrophotographic imaging member at one stage in a printing cycle.
Figure 3:
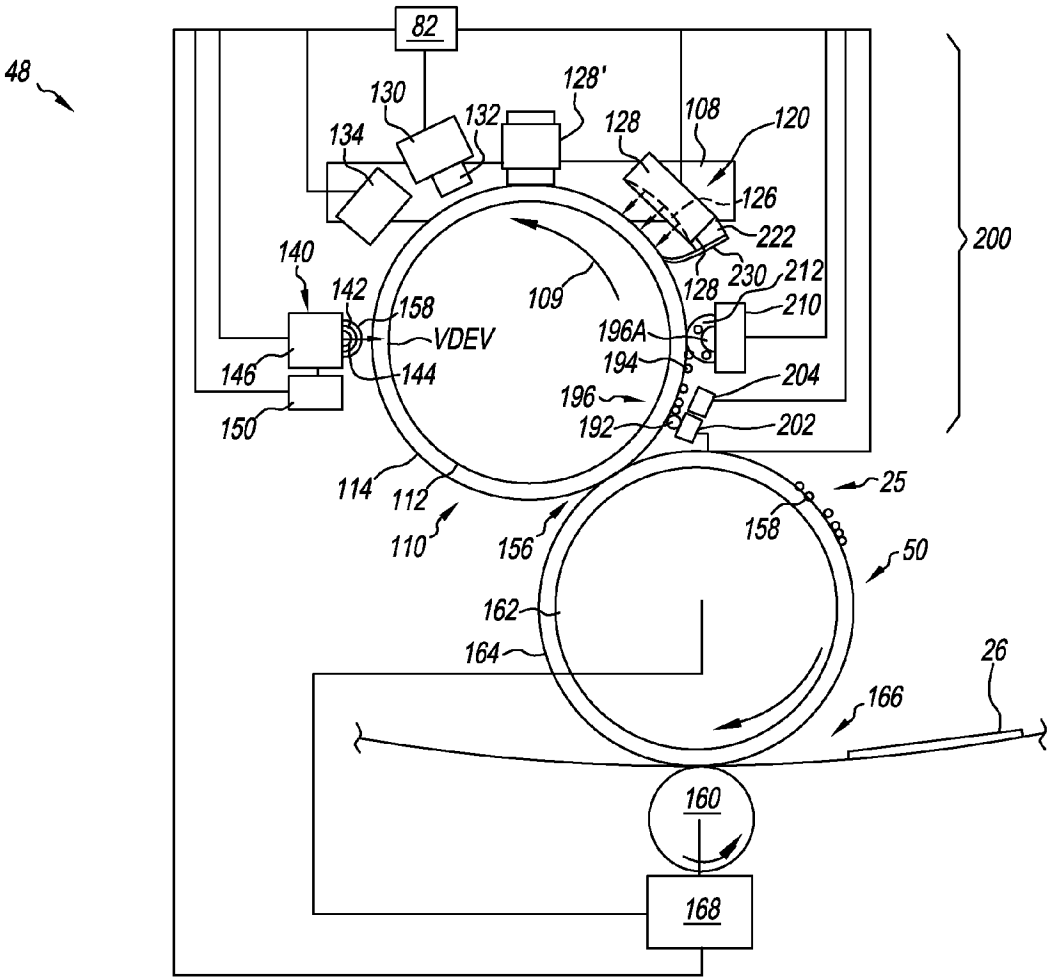
FIG. 3 shows the printing module of FIG. 2 at another stage in a printing cycle.
Figure 4:
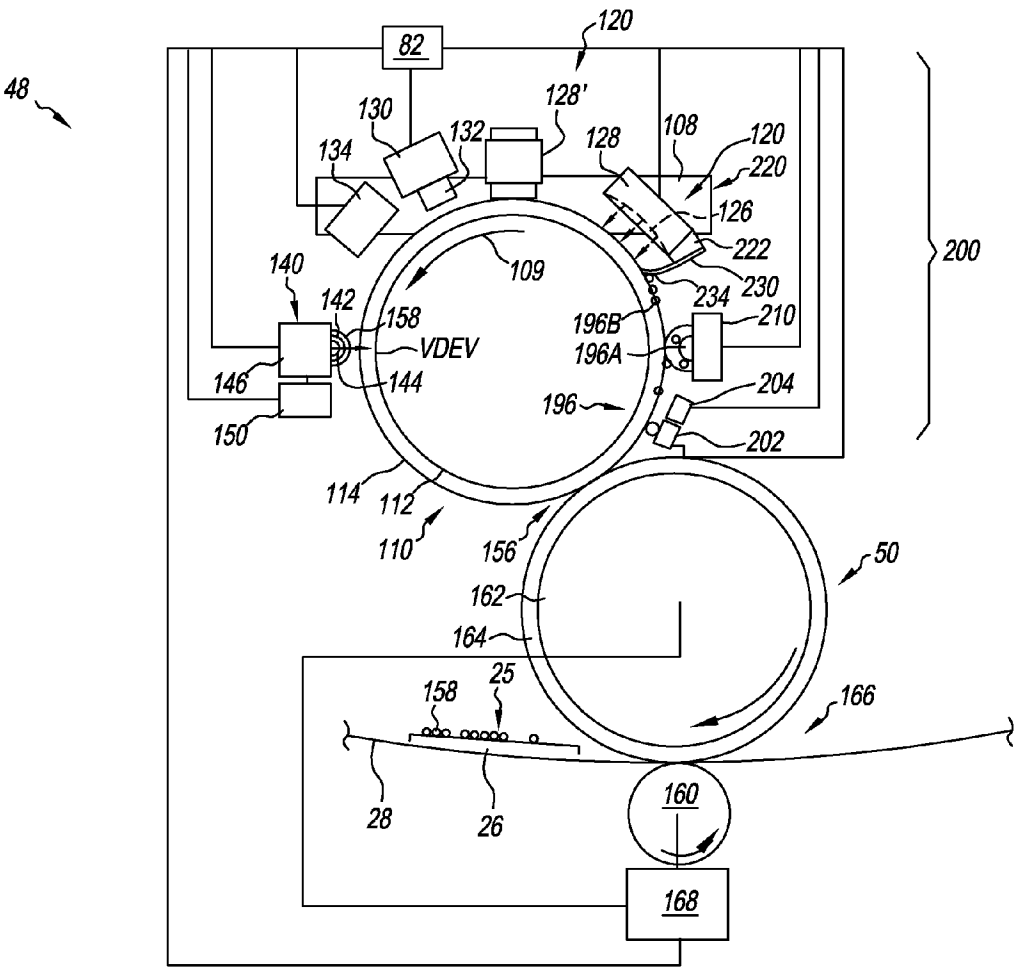
FIG. 4 shows the printing module of FIG. 2 at another stage in a printing cycle.

FIGS. 2, 3 and 4 show more details of an example of a printing module 48 representative of printing modules 40, 42, 44, and 46 of FIG. 1. In this embodiment, printing module 48 has a frame 108, a primary imaging system 110, a charging subsystem 120, a writing subsystem 130, a development station 140 and a cleaning system 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

Primary imaging system 110 includes a composite photoreceptive imaging member 114. In the embodiment of FIGS. 2, 3, and 4 composite photoreceptive imaging member 114 is on a support 112 that takes the form of a cylinder. However, in other embodiments, composite photoreceptive imaging member 114 can take other forms, such as a belt or plate and can be supported by hardware appropriate for such forms. As is indicated by arrow 109 in FIGS. 2, 3, and 4 composite photoreceptive imaging member 114 is rotated by a motor (not shown) such that composite photoreceptive imaging member 114 rotates from charging subsystem 120, to writing subsystem 130 to development station 140 and into a transfer nip 156 with a transfer subsystem 50 and past cleaning system 200 during a single revolution. In alternate embodiments, composite photoreceptive imaging member 114 can be rotated by way of another component that is driven by a motor such as a gear or a drum or belt with which there is some type of frictional engagement.

In the embodiment of FIGS. 2, 3 and 4, composite photoreceptive imaging member 114 is an insulator in the substantial absence of light so that initial differences of potential Vi can be retained on its surface. Upon exposure to light, the charge of the composite photoreceptive imaging member 114 in the exposed area is dissipated in whole or in part as a function of the amount of the exposure. In various embodiments, composite photoreceptive imaging member 114 mart of, or disposed over, the surface of a support 112 such as a drum and contains multiple layers the operation of which will be described in greater detail below.

Charging subsystem 120 is configured as is known in the art, to apply charge to composite photoreceptive imaging member 114. The charge applied by charging subsystem 120 creates a generally uniform initial difference of potential Vi relative to ground. The initial difference of potential Vi has a first polarity which can, for example, be a negative polarity. Here, charging subsystem 120 has a charging subsystem housing 128 within which a charging grid 126 is located. Grid 126 is driven by a power source (not shown) to charge composite photoreceptive imaging member 114. Other charging systems can also be used.

To provide generally uniform initial differences of potential charging, grid 126 is positioned within a narrow range of charging distances from composite photoreceptive imaging member 114. Grid 126 in turn is positioned by housing 128, thus housing 128 in turn is positioned within the narrow range of charging distances from composite photoreceptive imaging member 114. In this regard, both composite photoreceptive imaging member 114 and housing 128 are joined to a frame 108 in a manner that allows such precise positioning. Frame 108 can comprise any form of mechanical structure to which charging subsystem 120 and composite photoreceptive imaging member 114 can be joined in a controlled positional relationship at least for printing operations. Frame 108 can comprise a unitary structure or an assembly of individual structures as is known in the art. As will be discussed in greater detail below in certain embodiments, during maintenance operations, it can be useful to allow housing 128 to be joined to frame 108 in a manner that can be moved in a controllable fashion from the controlled positional relationship used for charging to a maintenance position. Frame 108 can support other components of printing module 48 including writing system 130, development system 140 and transfer subsystem 50.

As is also shown in FIGS. 2, 3 and 4, in this embodiment, an optional meter 128' is provided that measures the electrostatic charge on composite photoreceptive imaging member 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential Vi on composite photoreceptive imaging member 114. In other embodiments, a local controller or analog feedback circuit or the like can be used for this purpose.

Writing subsystem 130 is provided having a writer 132 that forms patterns of differences of potential on a composite photoreceptive imaging member 114. In this embodiment, this is done by exposing composite photoreceptive imaging member 114 to electromagnetic or other radiation that is modulated according to color separation image data to form a latent electrostatic image (e.g., of a color separation corresponding to the color of toner deposited at printing module 48) and that causes composite photoreceptive imaging member 114 to have a pattern of image modulated differences of potential at engine pixel location thereon. Writing subsystem 130 creates the differences of potential at engine pixel locations on composite photoreceptive imaging member 114 in accordance with information or instructions provided by any of printer controller 82, color separation image processor 96 and half-tone processor 98 as is known in the art.

Another meter 134 is optionally provided in this embodiment and measures charge within a non-image test patch area of composite photoreceptive imaging member 114 after composite photoreceptive imaging member 114 has been exposed to writer 132 to provide feedback related to differences of potential created using writer 132 and composite photoreceptive imaging member 114. Other meters and components (not shown) can be included to monitor and provide feedback regarding the operation of other systems described herein so that appropriate control can be provided.

Development station 140 has a toning shell 142 that provides a developer having a charged toner 158 near composite photoreceptive imaging member 114. Development station 140 also has a supply system 146 for providing the charged toner 158 to toning shell 142 and supply system 146 can be of any design that maintains or that provides appropriate levels of charged toner 158 at toning shell 142 during development. Often supply system 146 charges toner 158 by mixing toner 158 with a carrier that is selected to create a charge in toner 158 by way of the tribocharging effect. During this mixing process abrasive contact between toner 158 and the carrier can cause small particles of toner 158 and materials such as coatings that are applied to the toner 158 to separate from the toner. These small particles can migrate to the composite photoreceptive imaging member 114 during development to form at least some of residual material on composite photoreceptive imaging member 114.

Development station 140 also has a power supply 150 for providing a bias for toning shell 142. Power supply 150 can be of any design that can maintain the bias described herein. In the embodiment illustrated here, power supply 150 is shown optionally connected to printer controller 82 which can be used to control the operation of power supply 150.

The bias at toning shell 142 creates a development difference of potential VDEV relative to ground. The development difference of potential VDEV forms a net development difference of potential between toning shell 142 and individual engine pixel locations on composite photoreceptive imaging member 114. Toner 158 develops at individual engine pixel locations as a function of net development difference of potential. Such development produces a toner image 25 on composite photoreceptive imaging member 114 having toner quantities associated with the engine pixel locations that correspond to the engine pixel levels for the engine pixel locations. Conventionally, the net development difference of potential is 250 volts or more. By varying the difference of potential at an engine pixel location while maintaining a constant development difference of potential, it becomes possible to control an amount of toner that develops at an engine pixel location.

As is shown in FIG. 3, after a toner image 25 is formed, rotation of composite photoreceptive imaging member 114 causes toner image 25 to move through a first transfer nip 156 between composite photoreceptive imaging member 114 and a transfer subsystem 50. In this embodiment, transfer subsystem 50 has an intermediate transfer member 162 that receives toner image 25 at first transfer nip 156. As is also shown in FIG. 3, a substantial portion of the toner 158 used in forming toner image 25 transfers to transfer sub-system 50. However a residual amount 192 of toner 158 from toner image 25 remains on composite photoreceptive imaging member 114. Further, other residual material 194 can be attracted to composite photoreceptive imaging member 114 to form a layer or film thereon. Examples of such other residual material can include but is not limited to additives and coatings applied to the toner, agglomerates, carrier, paper fibers, dirt, dust and other particles that are attracted by a charged surface such as composite photoreceptive imaging member 114. Collectively such residual material 196 advances with composite photoreceptive imaging member 114 as it rotates away from transfer nip 156 and into cleaning system 200.

In the embodiment that is illustrated in FIGS. 2, 3, and 4 composite photoreceptive imaging member 114 carries residual material 196 away from composite photoreceptive imaging member 114 and past a pre-cleaning charger 202 and a charge eraser 204. Pre-cleaning charger 202 applies a charge to the surface of composite photoreceptive imaging member 114 to facilitate removal of residual material 196 while charge eraser 204 acts to cause any residual difference of potential on composite photoreceptive imaging member 114 to be discharged in preparation for the next writing operation.

As is further shown in FIG. 3, after composite photoreceptive imaging member 114 passes charge eraser 204 composite photoreceptive imaging member 114 is advanced to a first cleaner 210. In the embodiment that is illustrated in FIGS. 2-4, first cleaner 210 has a brush system 212 that rotates against composite photoreceptive imaging member 114 and that is electrically biased so as to draw a first portion 196*a* of residual material 196 from composite photoreceptive imaging member 114. Such a brush type embodiment of first cleaner 210 is recognized as being generally effective at removing toner particles of residual amount 192 from composite photoreceptive imaging member 114 and may remove some of the other residual material 194. Alternatively other cleaning systems known in the art can be used for first cleaner 210.

FIG. 4 shows the embodiment of FIGS. 2 and 3, after composite photoreceptive imaging member 114 rotates past first cleaner 210, at least a second portion 196*b* of residual material 196 remains on composite photoreceptive imaging member 114. As shown here, second portion 196*b* typically includes other residual material 194; however, in some instances second portion 196*b* can include toner 158. As is also shown in FIG. 4, further rotation of composite photoreceptive imaging member 114 causes second portion 196*b* of residual material 196 to be advanced to blade cleaning system 220. In the embodiment of FIG. 4, blade cleaning system 220 comprises a single cleaning blade member 230 of the wiper type that is held against composite photoreceptive imaging member 114 by a mounting 222 during rotation of composite photoreceptive imaging member 114 such that cleaning blade member 230 is resiliently biased into primary imaging member to create a normal force pressing against the electrostatic imaging member. When composite photoreceptive imaging member 114 and cleaning blade member 230 are moved relative to each other a cleaning force is created that cleans second portion 196*b* from composite photoreceptive imaging member 114.

Contact between cleaning blade member 230 and composite photoreceptive imaging member 114 creates the possibility that composite photoreceptive imaging member 114 will be tribocharged by cleaning blade member 230. Further, the normal force causes friction between cleaning blade member 230 and composite photoreceptive imaging member 114 that can create heat which, in some cases can create electromagnetic radiation such as infrared radiation to emit and which can cause composite photoreceptive imaging member 114 to generate charge in places and amounts other than those called for by the exposure pattern. Further, such friction can cause certain coatings or components of cleaning blade member 230 to form a coating or residue on composite photoreceptive imaging member 114 which can reflect or absorb light so that the ability of the composite photoreceptive imaging member 114 to charge or to discharge when exposed to electromagnetic radiation is compromised.

Embodiment of Composite Photoreceptive Imaging Member

Figure 5:
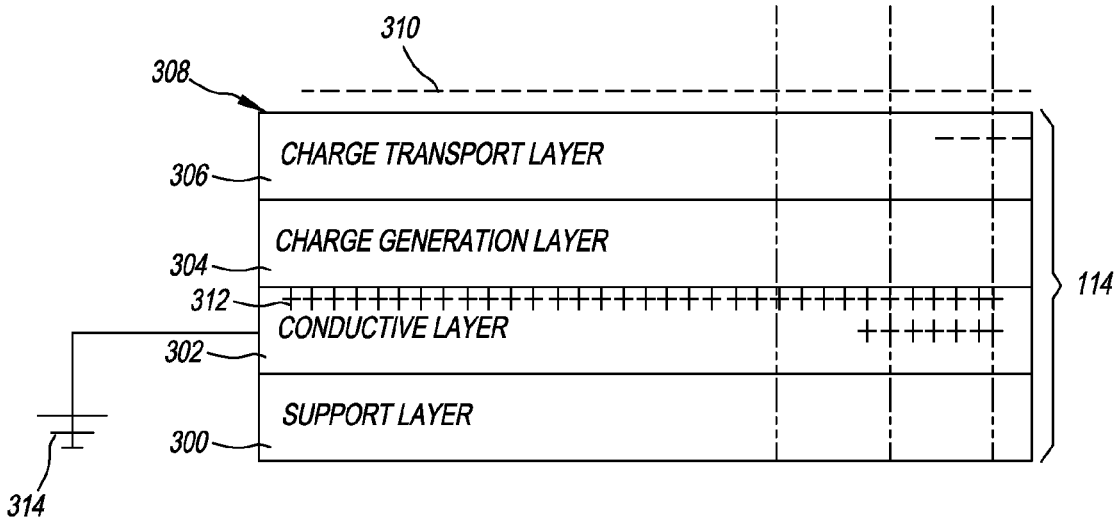
FIG. 5 illustrates one embodiment of a composite photoreceptive imaging member.

FIG. 5 illustrates a cross section of a first embodiment of a composite photoreceptive imaging member 114. In this embodiment, composite photoreceptive imaging member 114 comprises a multi-layer composite photoreceptive imaging member 114 or what is often referred to as a composite photoreceptor. In the embodiment of FIG. 5, composite photoreceptive imaging member 114 is shown having, a support 300, a conductive layer 302, a charge generation layer 304, a charge transport layer 306 and an outer surface 308. Electrically conductive layer 302 interfaces with support 300; photoconductive charge generation layer 304 interfaces with electrically conductive layer 302; and charge transport layer 306 interfaces with charge generation layer 304 and outer surface 308.

In the embodiment illustrated, support 300 comprises a material that gives the composite photoreceptive imaging member 114 mechanical strength such as polyester or aluminum. Conductive layer 302 is optional and can be coated or otherwise provided between photoconductive charge generation layer 304 and support 300. As is illustrated here, conductive layer 302 is connected to or otherwise in electrical contact with a ground 314. Where support 300 is conductive, conductive layer 302 can comprise a conductive portion of conductive support 300 which can be connected to or otherwise in electrical contact with ground 314 and conductive layer 302

Figure 6:
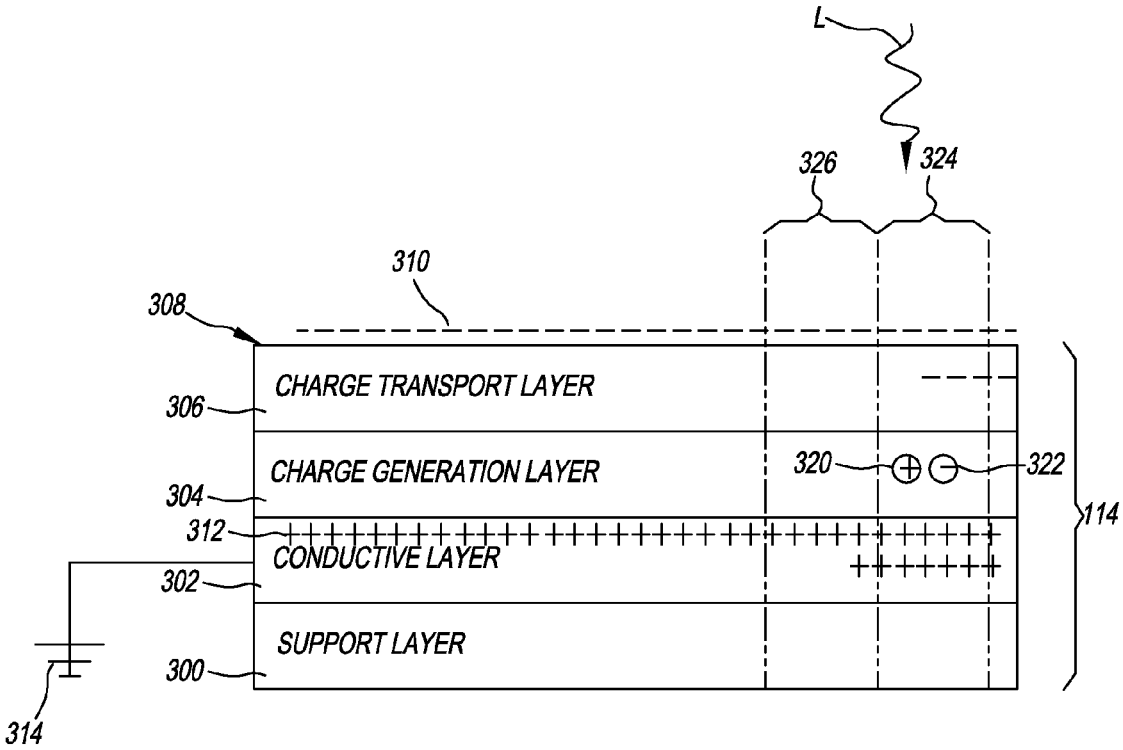
FIG. 6 illustrates the embodiment of FIG. 5 during exposure.

Charge generation layer 304, also known in the art as a photoconductive layer, generally consists of photoconductive material in a polymer binder. As is shown in FIG. 6, charge generation layer 304 supplies charge holes 320 and electrons 322 that can be drawn from charge generation layer 304 when charge generation layer 304 is exposed to appropriate electrical conditions and electromagnetic radiation.

Charge transport layer 306 has a material that allows charge holes 320 to migrate from charge generation layer 304 toward outer surface 308 while resisting migration of electrons 322 from charge generation layer 304 to outer surface 308. Charge transport layer 306 can have an air interface opposite the interface with charge generation layer 304 that provides an outer surface 308. Alternatively, charge transport layer 306 can be overcoated or otherwise provided with a layer of one or more materials that provide specific properties at outer surface 308. For example, charge transport layer 306 can be overcoated or otherwise provided with a ceramic such as a solgel or a diamond-like carbon.

As described generally above, during image writing, composite photoreceptive imaging member 114 is generally uniformly charged to an initial difference of potential Vi relative to ground 314. This provides a generally uniform coverage of ions 310 on outer surface 308 of composite photoreceptive imaging member 114 and generates a countercharge 312 at conductive layer 302. Countercharge 312 is equal in magnitude and opposite in polarity to the charge of ions 310 on outer surface 308.

An electrostatic latent image is formed by image-wise exposing the composite photoreceptive imaging member 114. As is shown in FIG. 6, when composite photoreceptive imaging member 114 is image-wise exposed, by a pattern of electromagnetic radiation which can be for example and without limitation visible light L, different engine pixel locations such as engine pixel locations 324 and 326 on composite photoreceptive imaging member 114 can receive different amounts of exposure. In the example of FIG. 6 an engine pixel location 324 receives a relatively high level of exposure to a light L while an adjacent engine pixel location 326 receives no exposure. In the embodiment of FIG. 6, charge generation layer 304 generates charge holes 320 and electrons 322 in amounts that generally increase monotonically with increases in the intensity of the imagewise exposure at engine pixel locations. Accordingly, charge generation layer 304 provides charge holes 320 and electrons 322 in the portion of charge generation layer 304 that corresponds to engine pixel location 324 and does not cause any charge holes 320 or electrons 322 to be provided in the portion of charge generation layer 304 that corresponds to engine pixel location 326.

Figure 7:
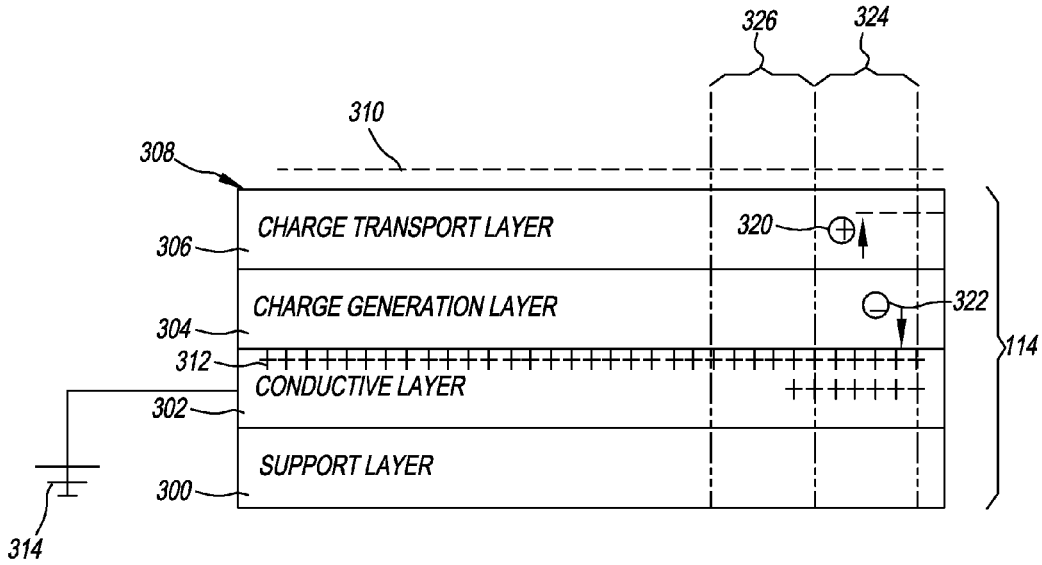
FIG. 7 illustrates the embodiment of FIG. 5 while charge holes and electrons are migrating.

As is illustrated in FIG. 7, ions 310 formed on outer surface 308 are negatively charged and countercharge 312 in conductive layer 302 is positively charged. This causes charge holes 320 to seek to migrate toward ions 310 while electrons 322 seek to migrate toward conductive layer 302.

However, in the time between the formation of the latent image and the conversion of the latent image to a visible image (development) the charge on the composite photoreceptive imaging member 114 can decay due to thermal effects. The effect of such decay is reduced by charge transport layer 306 which allows charge holes 320 to pass through charge transport layer 306 but generally prevents electrons 312 from passing through charge transport layer 306. In general, charge transport layer 306 contains materials that conduct charge holes 320 far better than electrons 322 or ions 310. Various materials and types of charge transport layers are known to those of skill in the art.

Figure 8:
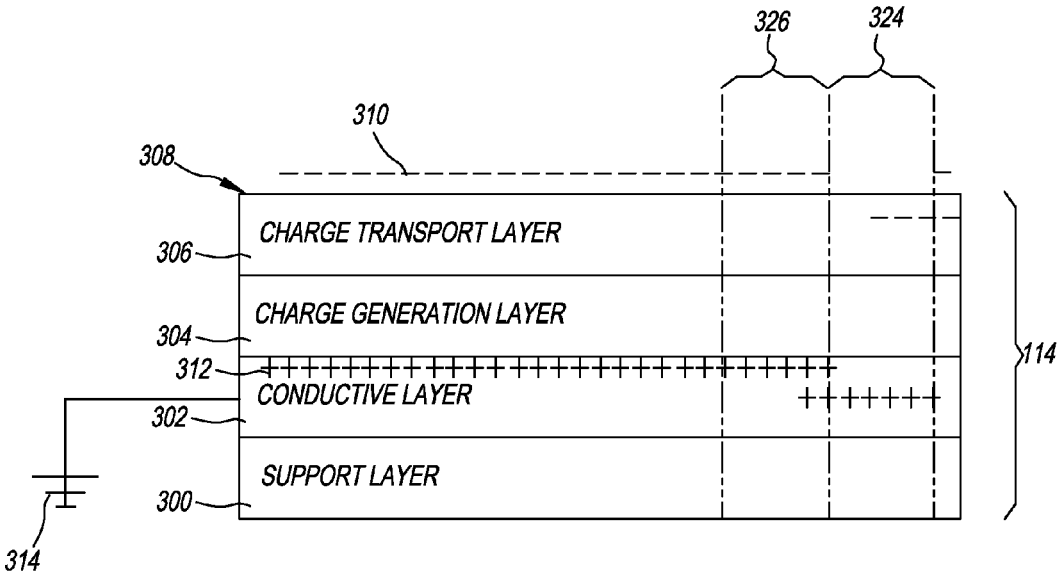
FIG. 8 illustrates the embodiment of FIG. 5 after migration.

As is shown in FIG. 8, when migration of charge holes 320 generated at engine pixel location 324 through charge transport layer 306 is complete, charge holes 320 electrically neutralize at least some of the charge provided by ions 310 at engine pixel location 324 while electrons 324 electrically neutralize at least part of a countercharge 312 at engine pixel location 324 without meaningfully influencing the charge provided by ions 310 or countercharge 312 at adjacent engine pixel location 326. Accordingly, each exposed engine pixel location on composite photoreceptive imaging member 114 can have an intensity that is modulated according to the image-wise exposure made at that engine pixel location. In half-tone type embodiments, the modulation can be an off-on modulation, while in other embodiments there can be a range of exposure levels.

Another feature of outer surface 308 of composite photoreceptive imaging member 114 is that it is formed from materials that are electrically insulating. This allows a pattern of differences of potential relative to ground 314 to be formed at individual engine pixel locations on composite photoreceptive imaging member 114 without cross talk. For example, after exposure there is a substantial difference of potential at engine pixel location 326 and a smaller difference of potential at engine pixel location 324. If a conductive path exists between engine pixel location 324 and engine pixel location 326 charge can transfer between engine pixel locations 324 and 326 than the difference of potential between these engine pixels can normalize. This causes a loss of image information and degradation to occur.

Figure 9:
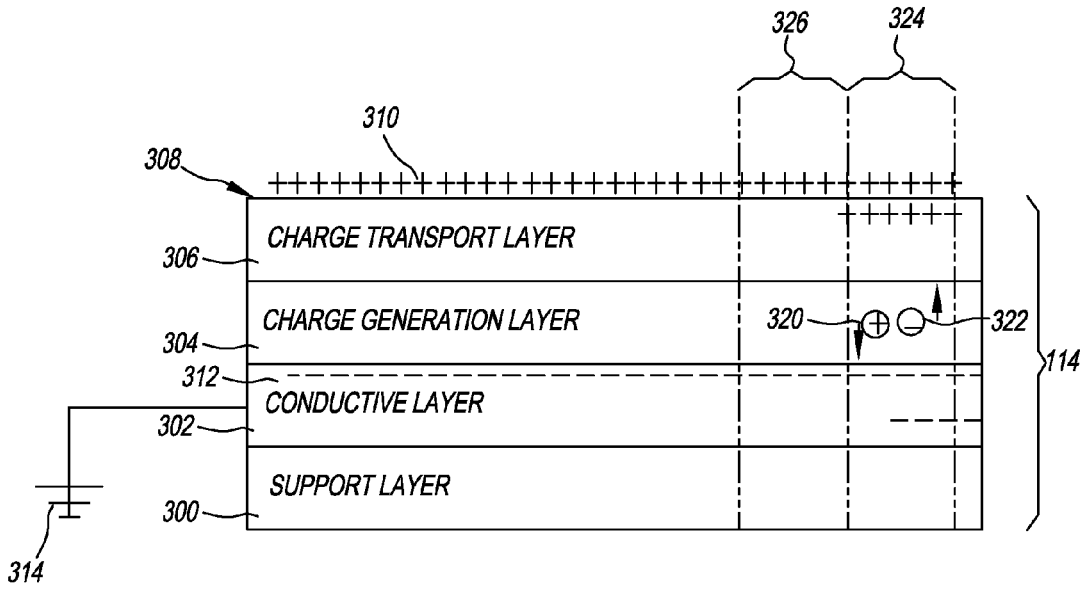
FIG. 9 illustrates the embodiment of FIG. 5 with a triboelectrically induced charge after exposure.

However as is illustrated in FIG. 9, contact between cleaning blade member 230 and composite photoreceptive imaging member 114 can cause the charge pattern formed on composite photoreceptive imaging member 114 to have unintended image artifacts. In one example, contact between composite photoreceptive imaging member 114 and cleaning blade member 230 can cause tribocharging of composite photoreceptive imaging member 114. In another example, frictional forces acting at the point of contact between composite photoreceptive imaging member 114 and cleaning blade member 230 can create heat that emits infrared light which can cause charge generation layer 304 to generate electrons and charge holes in unintended locations on composite photoreceptive imaging member 114. As noted above, this can create charges that influence the pattern of charge formed on composite photoreceptive imaging member 114.

As is illustrated in FIG. 9, if a composite photoreceptive imaging member 114 of FIGS. 5-8 is tribocharged through contact with a cleaning blade member 230 such that positive ions 310 form on outer surface 308, a negative countercharge 312 will be created in conductive layer 302. If this composite photoreceptive imaging member 114 is subsequently exposed to light, charge holes 320 and electrons 322 will arise in charge generation layer 304. Where this occurs charge holes 320 seek to migrate to conductive layer 302 while electrons 322 seek to migrate to positive ions.

Figure 10:
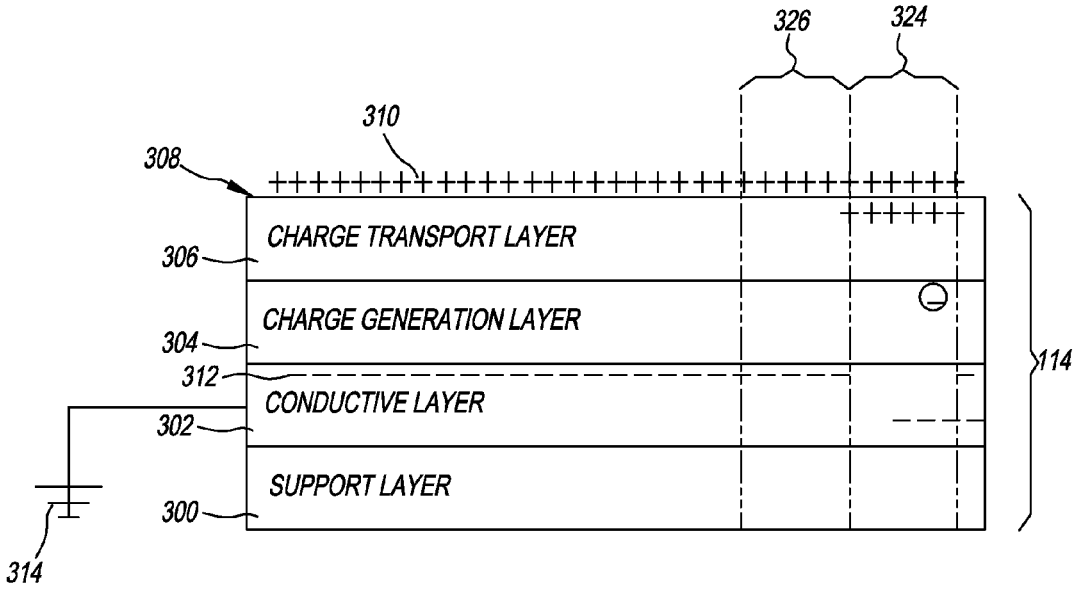
FIG. 10 illustrates the embodiment of FIG. 5 with a triboelectrically induced charge after charge holes have migrated.

As is shown in FIG. 10, charge holes 322 travel to and electrically neutralize negative countercharge 312. However, electrons 322 do not easily pass through the charge transport layer 306 and therefore accumulate in charge transport layer 306. This accumulation of electrons 322 arises at one or more engine pixel locations. The accumulated electrons 322 are not dissipated because of the presence of charge transport layer 306. These electrons 322 generate a charge that can influence the amount of toner that develops on composite photoreceptive imaging member 114. This effect can become permanent and can cause, for example, toner to develop in engine pixel locations that is in excess of what is expected in response to the image modulation supplied at the engine pixel location or this can cause less toner to be supplied at an engine pixel location than is expected based upon the image modulation at the engine pixel location, with the former effect occurring at engine pixel locations that have an accumulation of charge of a polarity that is the opposite of the polarity of the toner and with the latter effect occurring at engine pixel locations that have an accumulation of charge of a polarity that is the same as the polarity of the toner.

As is noted above, other effects of a cleaning blade member 230 can influence whether a toner image is formed on a composite photoreceptive imaging member 114 that corresponds to the exposure of the photoreceptive imaging member. Examples of such effects include whether cleaning blade member 230 induces thermal effects that increase the rate of decay of the charge formed at an engine pixel location or whether the cleaning blade member 230 itself leaves a residue that absorbs, reflects light or other electromagnetic radiation or otherwise causes different portions of the composite photoreceptive imaging member to receive intensities of imagewise exposure.

Alternate Embodiment of Composite Photoreceptive Imaging Member

Figure 11:
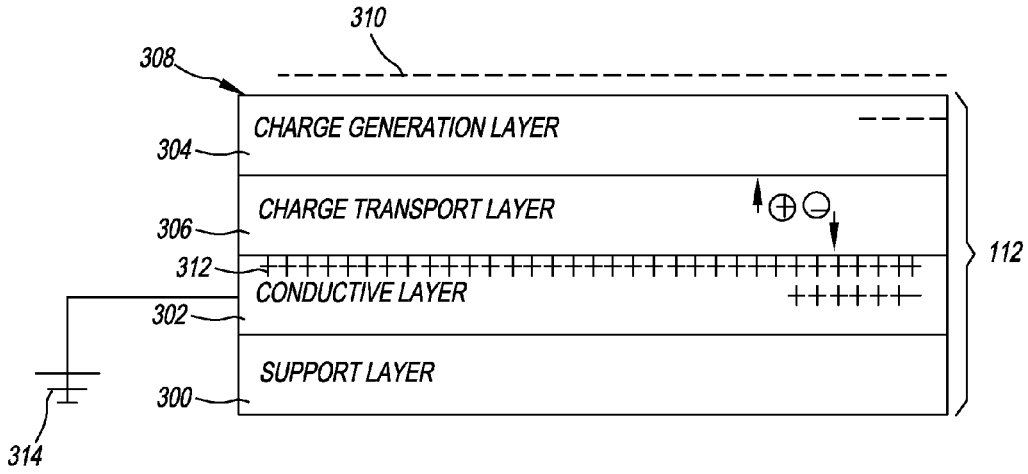
FIG. 11 illustrates another embodiment of a composite photoreceptive imaging member.

FIG. 11 illustrates a cross section of a second embodiment of a composite photoreceptive imaging member 114. In this embodiment, composite photoreceptive imaging member 114 has a different layer arrangement in what is often referred to as an inverse composite photoreceptor. In the embodiment of FIG. 11, composite photoreceptive imaging member 114 is shown having, a support 300, a conductive layer 302, a charge generation layer 304, a charge transport layer 306 and an outer surface 308. However, in this embodiment, electrically conductive layer 302 interfaces with support 300 and with charge transport layer 306; charge transport layer 306 interfaces with charge transport layer 306 and with outer surface 308.

In this embodiment, support 300 comprises a material that gives the composite photoreceptive imaging member 114 mechanical strength such as polyester or aluminum. Conductive layer 302 is optional and can be coated or otherwise provided between photoconductive charge generation layer 304 and support 300. As is illustrated here, conductive layer 302 is connected to or otherwise in electrical contact with a ground 314. Where support 300 is conductive, support 300 can be connected to or otherwise in electrical contact with ground 314 and conductive layer 302 can be omitted.

Figure 12:
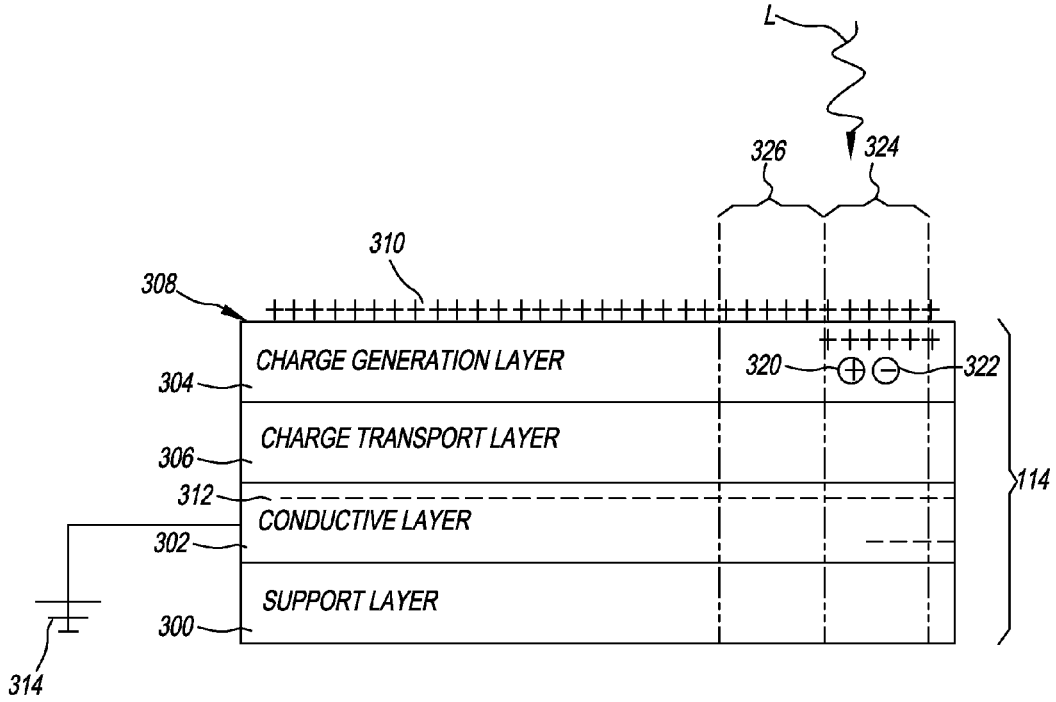
FIG. 12 illustrates the embodiment of FIG. 11 during exposure.

Charge generation layer 304, also known in the art as a photoconductive layer, generally consists of photoconductive material in a polymer binder. As is shown in FIG. 12, charge generation layer 304 supplies charge holes 320 and electrons 322 when charge generation layer 304 is exposed to an appropriate electrical field and electromagnetic radiation such as light L. Charge generation layer 304 can have an air interface opposite the interface with charge transport layer 306 that provides outer surface 308. Alternatively, charge generation layer 304 can be overcoated or otherwise provided with a layer of one or more materials that provide specific mechanical properties at outer surface 308. For example, charge generation layer 304 can be overcoated or otherwise provided with a ceramic such as a solgel or a diamond-like carbon.

Charge transport layer 306 has a material that conducts charge holes 320 from charge generation layer 304 toward conductive layer 302 or a conduct support while resisting transport of electrons 322.

As described generally above, during image writing, composite photoreceptive imaging member 114 is generally uniformly charged to initial differences of potential Vi relative to ground 314. This provides a generally uniform coverage of ions 310 on outer surface 308 of composite photoreceptive imaging member 114 and generates a countercharge 312 at conductive layer 302. Countercharge 312 is equal in magnitude and opposite in polarity to the polarity of the charge of ions 310 on outer surface 308.

An electrostatic latent image is formed by image-wise exposing the composite photoreceptive imaging member 114. As is shown in FIG. 12, when composite photoreceptive imaging member 114 is image-wise exposed, by a pattern of electromagnetic radiation, which can be for example and without limitation visible light L, different engine pixel locations such as engine pixel location 324 and engine pixel location 326 on composite photoreceptive imaging member 114 can receive different amounts of exposure. In the example of FIG. 12, engine pixel location 324 receives a relatively high level of exposure to light L while adjacent engine pixel location 326 receives no exposure. In the embodiment of FIG. 12, charge generation layer 304 generates charge holes 320 and electrons 322 in amounts that generally increase monotonically with increases in the intensity of the imagewise exposure at engine pixel locations. Accordingly, charge generation layer 304 provides charge holes 320 and electrons 322 in the portion of charge generation layer 304 that corresponds to engine pixel location 324 and does not cause any charge holes 320 or electrons 322 to be provided in the portion of charge generation layer 304 that corresponds to at engine pixel location 326.

Figure 13:
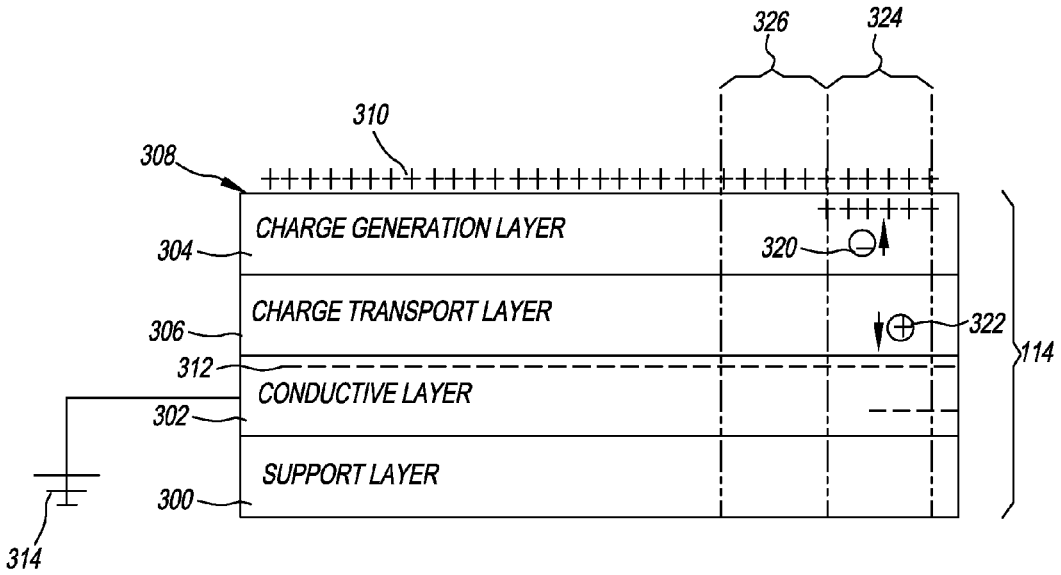
FIG. 13 illustrates the embodiment of FIG. 11 while charge holes and electrons are migrating.

As is illustrated in FIG. 12, ions 310 formed on outer surface 308 are positively charged countercharge in conductive layer 302 is negatively charged. This causes electrons 322 to seek to migrate toward ions 310 while causing charge holes 320 to seek to migrate toward conductive layer 302 as is illustrated in FIG. 13.

However, in the time between the formation of the latent image and the conversion of the latent image to a visible image (development) the charge on the composite photoreceptive imaging member 114 can decay due to thermal effects. The effect of such decay is reduced by charge transport layer 306 which allows charge holes 320 to pass through charge transport layer 306 but generally prevents electrons 322 from passing through charge transport layer 306 to conductive layer 302. In general, charge transport layer 306 contains materials that conduct charge holes 320 far better than electrons 322 or ions 310. Various types of charge transport layers are known to those of skill in the art.

Figure 14:
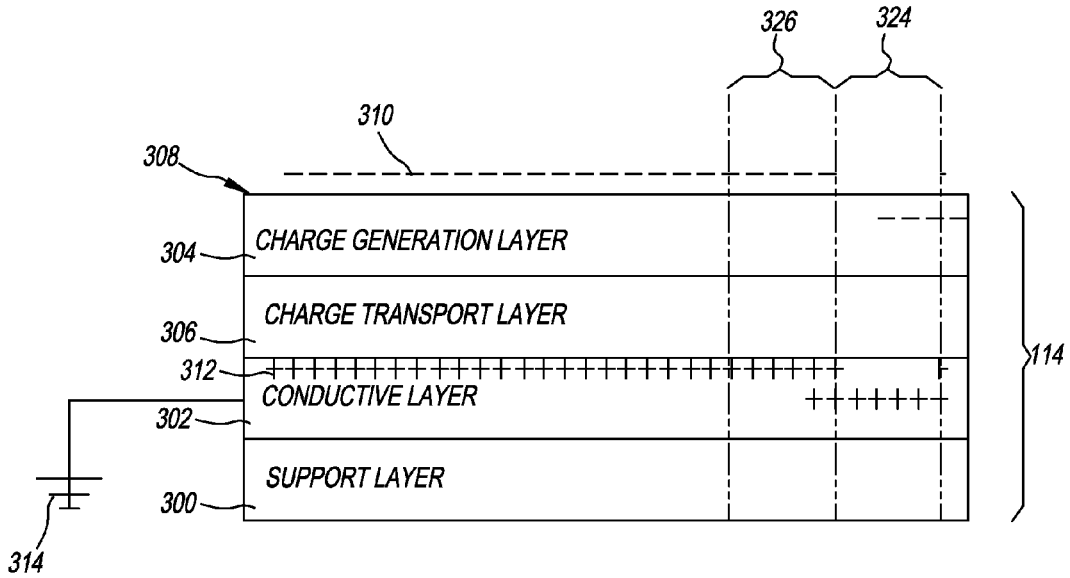
FIG. 14 illustrates the embodiment of FIG. 11 after migration.

As is shown in FIG. 14, when migration of charge holes 320 through charge transport layer 306 is complete, charge holes 320 electrically neutralize at least some of the negative countercharge 312 at particular engine pixel locations i.e.

engine pixel location 324 while electrons 324 electrically neutralize at least part of a charge provided by ions 310 at engine pixel location 324 without meaningfully influencing the charge provided by ions 310 or countercharge 312 at adjacent engine pixel location 326. In this way, each exposed engine pixel location on composite photoreceptive imaging member 114 can have an intensity that is modulated according to the image-wise exposure made at that engine pixel location. In half-tone type embodiments, the modulation can be an off-on modulation, while in other embodiments there can be a range of exposure levels.

Another feature of outer surface 308 of composite photoreceptive imaging member 114 is that it is formed from materials that are electrically insulating. This allows a pattern of differences of potential relative to ground 314 to be formed at individual engine pixel locations on composite photoreceptive imaging member 114 without cross talk. For example, after exposure there is a substantial difference of potential at engine pixel location 326 and a smaller difference of potential at engine pixel location 324. If a conductive path exists between engine pixel location 324 and engine pixel location 326 charge can transfer between engine pixel locations 324 and 326 then the difference of potential between these engine pixels can normalize. This causes a loss of image information and degradation to occur.

However, as is illustrated in FIG. 14, contact between cleaning blade member 230 and the composite photoreceptive imaging member 114 can cause the charge pattern formed on composite photoreceptive imaging member 114 to have unintended image artifacts. Specifically, contact between composite photoreceptive imaging member 114 and cleaning blade member 230 can cause tribocharging of the composite photoreceptive imaging member 114 and frictional forces acting at the point of contact between composite photoreceptive imaging member 114 and cleaning blade member 230 can create heat that emits infrared light which can cause charge generation layer 304 to generate electrons 322 and charge holes 320 or leave residues that modify the responsiveness of the charge generation layer to light.

Figure 15:
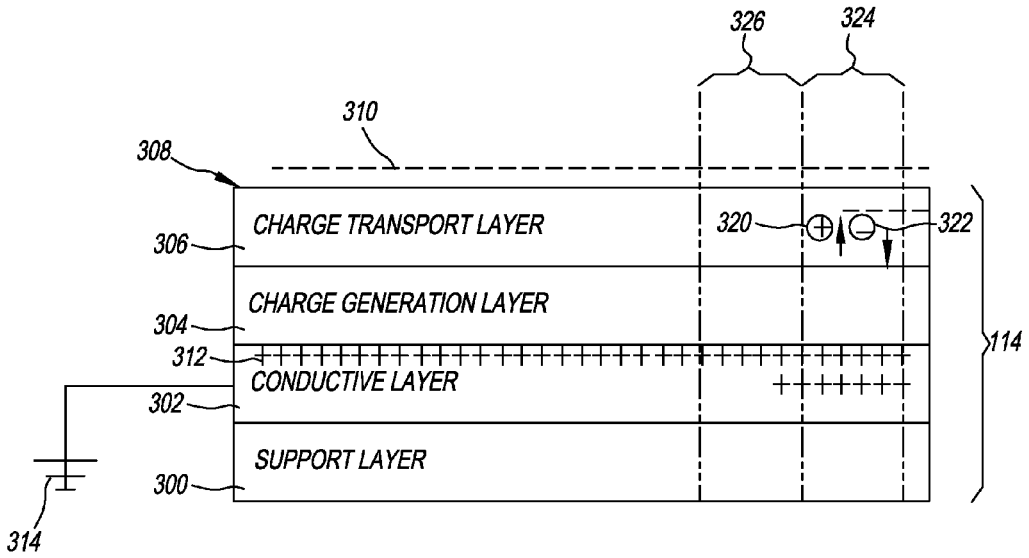
FIG. 15 illustrates the embodiment of FIG. 11 with a triboelectrically induced charge after exposure.
Figure 16:
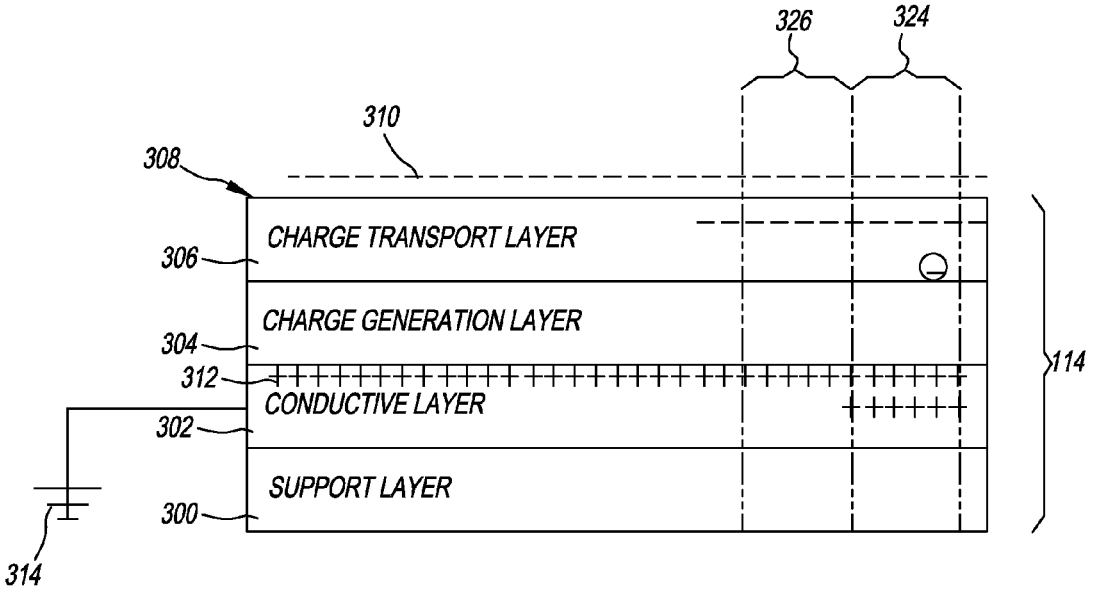
FIG. 16 illustrates the embodiment of FIG. 11 with a triboelectrically induced charge after charge holes have migrated.

As is illustrated in FIG. 15, if a positively charging composite photoreceptive imaging member 114 such as that illustrated in FIGS. 10-13 is tribocharged through contact for example with a cleaning blade member 230, negative ions 310 are formed on outer surface 308 of the photoreceptive imaging member 114 and a positive countercharge 312 is formed in conductive layer 302. This creates an electromagnetic field that urges charge holes 320 to migrate up to outer surface 308 and electrons 322 to migrate to toward the charge transport layer 306. However, as is discussed above, charge transport layer 306 does not generally transfer will become trapped there. As is shown in FIG. 16, this forms an accumulation of electrons 322 that is not dissipated easily because of the presence of charge transport layer 306. The accumulated electrons 322 generate charges that can influence the amount of toner that develops on composite photoreceptive imaging member 114. In some cases, the tribocharging induce charges can permanently alter that electrostatic profile of electrostatic imaging member. These can cause, for example, toner to develop in engine pixel locations that is in excess what is expected in response to in the image modulation supplied at the engine pixel location or this can cause less toner to be supplied at an engine pixel location than is expected based upon the image modulation at the engine pixel location, with the former effect occurring at engine pixel locations that have an accumulation of charge of a polarity that is the opposite of the polarity of the toner and with the latter effect occurring at engine pixel locations that have an accumulation of charge of a polarity that is the same as the polarity of the toner.

As is noted above, other effects of a cleaning blade member 230 can influence whether a toner image is formed on a composite photoreceptive imaging member 114 such as whether the cleaning blade member 230 induces thermal effects that increase the rate of decay of the charge formed at an engine pixel location or whether the cleaning blade member 230 itself leaves a residue that absorbs, reflects or otherwise causes different portions of the composite photoreceptive imaging member 114 to receive intensities of imagewise exposure. Further the heat generated by the friction effects can itself cause pairs of charge holes 320 and electrons 322 to form in the charge generation layer 304.

To measure the amount of tribocharging, the following test is employed:

a magnetic development station containing a rotating magnetic core of alternating polarity magnets and a coaxial stainless steel shell is used to bring electrophotographic developer into contact with the material of interest. The shell is approximately 6 inches long and 2 inches in diameter. The development station should contain between 10 and 24 magnets. In the present measurements, the development station contains 20 magnets, each magnet having a magnetic strength of between 1,100 gauss and 1,500 gauss. The magnetic core rotates at approximately 600 rpm. The rotational speed of the shell is adjusted so that the surface speed of flow of the developer matches the speed of the material under consideration.

During the test, 12 g+/−2 g of developer are loaded onto the shell of a development station. The developer is a commercially available material sold as Eastman Kodak Company, Rochester, N.Y., USA such as a black toner and a ferrite carrier. The carrier and the toner can be purchased separately and mixed in the lab. Alternatively, the developer can be obtained as a premixed material. The toner contains a polyester binder and has a median volume-weighted diameter between 6 um and 8 um, as measured with a Coulter Multisizer. The toner concentration is between 5% and 8% by weight of the developer, preferably 6+0.5%.

The material to be evaluated is placed on a sled. The surface of the material to be evaluated is spaced between 12 mils and 20 mils from the surface of the shell of the development station. The sled is translatable across the development station perpendicular to the cylindrical axis of symmetry of the shell. The translation speed is between 1 and 3 inches per second, preferably 2 inches per second.

The rotational speed of the shell is set so that the speed of the developer matches the speed of the material being evaluated so that there is no shearing between the developer and the material. The material should be coated onto or placed onto a grounded plate so that the potential on the surface of the material can be measured. If a photoreceptor is the material, measurements should be done in the dark. The potential on the material is initially measured, the material transported across the developer while the development station is being operated as described with the shell of the development station set to equal the initial potential on the material, preferably both being zero. After transporting across the developer, any deposited toner is removed using compressed air and the potential on the member remeasured. Any difference between the second and first measurements is due to tribocharging.

An alternative test, if desired, for a cleaning blade in contact with a photoreceptor can be performed as follows: The cleaning blade is engaged against the photoreceptor in the manner in which it is to be used. The voltage on the clean photoreceptor, i.e. a photoreceptor not having significant quantities of contaminants such as toner, is measured before and after engaging the cleaning blade and the difference of potential is the tribocharging voltage.

Where it is desired to provide a composite photoreceptive imaging member 114 consisting of a supporting material such as a polyester such as Estar or Mylar, a conductive layer 302 can comprise a layer of nickel coated on support layer 300. In such an embodiment, a charge generation layer 306 can be coated on conductive layer 302, and a charge transport layer 306 that preferentially conducts holes can be coated on the conductive layer 302. In such a case any tribocharge of composite photoreceptive imaging member 114 should not be positive and preferably should be between zero and about minus (−) 20 volts and more preferably less than minus (−) 10 volts.

If the composite photoreceptive imaging member 114 has an inverse structure whereby the charge transport layer 306 is coated onto the conductive layer 302 and the charge generation layer 304 is coated onto the charge transport layer 306, the tribocharge of composite photoreceptive imaging member 114 should not be negative and preferably should between zero and about plus (+) 20 volts and more preferably less than plus (+) 10 volts.

Friction Controlling First Material

Tribocharging of the composite photoreceptive imaging member 114 is controlled by defining the composite photoreceptive imaging member 114 and a cleaning surface layer of cleaning blade member 230 in a manner to control the extent of any tribocharging of composite photoreceptive imaging member 114.

Figure 17B:
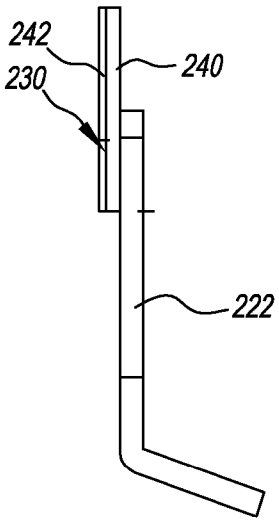
FIGS. 17A, 17B, and 17C are perspective, front, and side elevations of one embodiment of a cleaning blade member.
Figure 17A:
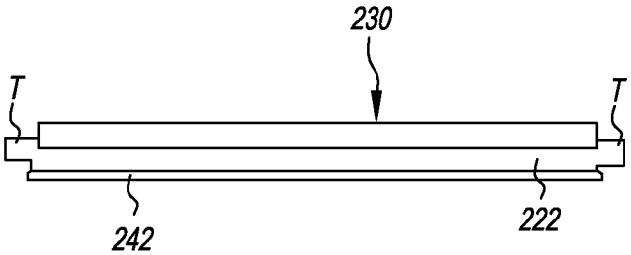
Figure 17C:
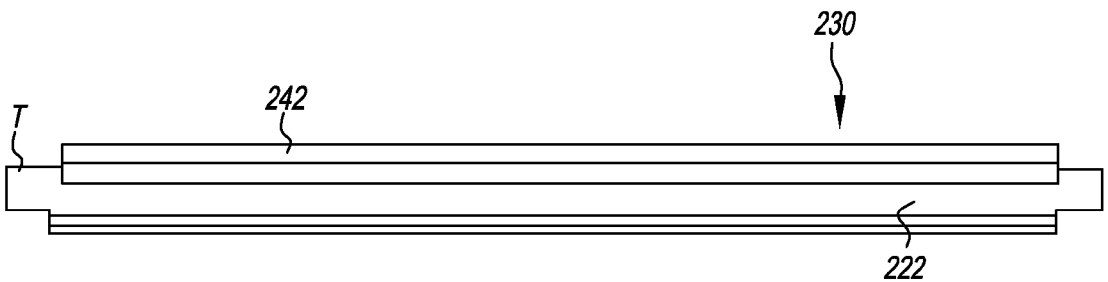

FIGS. 17A, 17B and 17C are respectively perspective, front, and side elevations of one embodiment of a cleaning blade member 230. In the embodiment of FIGS. 17A-17C, cleaning blade member 230 comprises a polymer cleaning blade member substrate 240 upon which an outermost cleaning surface layer 242 is directly disposed. Polyurethane is polymer useful as a cleaning blade member substrate 240. It is known for its toughness and ability to be tailored to various degrees of hardness (Shore A). Other polymers that are useful as substrates include but are not limited to, polyamideimides, fluorinated resins such as poly(vinylidene fluoride) and poly (ethylene-co-tetrafluoroethylene), vinyl chloride-vinyl acetate copolymers, ABS resins, and poly(butylene or terephthalate). Mixtures of the noted resins can also be used. These resins can also be blended with elastic materials and can also include other additives including antistatic agents. The cleaning blade member substrate 240 can have a thickness of at least 0.85 mm and up to and including 2.5 mm, and a width of at least 5 mm and up to and including 20 mm to fabricate cleaning blade members 230 with a free length of at least 5 mm and up to and including 12 mm, depending upon the desired load against the material to be cleaned.

Cleaning surface layer 242 comprises an outermost surface layer on cleaning blade member 230 and in this embodiment is disposed directly on cleaning blade member substrate 240 meaning that there are no intermediate layers. The cleaning surface layer 242 (also known as an "overcoat") consists essentially of a first material comprising a non-particulate, non-fluorinated ceramer or fluoroceramer and a second material comprising nanosized inorganic particles. Thus, this cleaning surface layer 242 contains no other needed components for toner transfer and any additives (such as antioxidants, colorants, or lubricants) are optional. The outermost cleaning surface layer 242 is generally transparent and has an average thickness, in dry form, of at least 0.5 μm and up to and including 20 μm, or typically at least 1 μm and up to and including 15 μm, or even at least 1 μm and up to 12 μm.

The cleaning surface layer 242 generally has a Young's modulus of at least 50 MPa and up to and including 2000 MPa. This Young's modulus does not appear to be affected by the presence of the nanosized inorganic particles. Surprisingly, ceramers and fluoroceramers having high amounts of alkoxysilane crosslinker and high amounts of nanosized inorganic particles do not readily crack.

The cleaning surface layer 242 has a measured storage modulus of at least 0.1 GPa and up to and including 2 GPa, or typically at least 0.3 GPa and up to and including 1.75 GPa, or still again at least 0.5 GPa and up to and including 1.5 GPa, when measured using a Dynamic Mechanical Analyzer (DMA).

In addition, the cleaning surface layer 242 has a dynamic (kinetic) coefficient of friction of less than 0.5 or typically less than 0.4, as measured using a model 3M90 slip-peel tester from Analogic Measurometer II (Instrometers, Inc.). Strips of the fluoroceramer coated polyurethane substrate were attached to a weighted sled that was pulled over a photoconductor film on a horizontal surface while contacting the fluoroceramer coating and a load cell is used to measure the force needed to move the sled. The static and dynamic (kinetic) coefficients of friction were then calculated.

In addition, the cleaning surface layer 242 generally has an average surface roughness Ra of less than 50 nm, as measured by Atomic Force Microscopy (AFM).

The ceramer used in cleaning surface layer 242 generally comprises a polyurethane silicate hybrid organic-inorganic network formed as a reaction product of a non-fluorinated polyurethane having terminal reactive alkoxysilane moieties with a tetrasiloxysilane compound. More typically, the polyurethane with terminal alkoxysilane groups is the reaction product of one or more aliphatic, non-fluorinated polyols having terminal hydroxyl groups and an alkoxysilane-substituted alkyl-substituted isocyanate compound. Suitable aliphatic polyols have molecular weights of at least 60 and up to and including 8000 and can be polymeric in composition. Polymeric aliphatic polyols can further include a plurality of functional moieties such as an ester, ether, urethane, non-terminal hydroxyl, or combinations of these moieties. Polymeric polyols containing ether functions can also be polytetramethylene glycols having number average molecular weights of at least 200 and up to and including 6500, which can be obtained from various commercial sources. For example, Terathane™-2900, -2000, -1000, and -650 polytetramethylene glycols that are available from DuPont, are useful in the reactions described above.

Polyols having a plurality of urethane and ether groups are obtained by reaction of polyethylene glycols with alkylene diisocyanate compounds having 4 to 16 aliphatic carbon atoms, such as 1,4-diisocyanatobutane, 1,6-diisocyanatohexane, 1,12-diisocyanatododecane, and isophorone diisocyanate [5-isocyanato-1-(1-isocyanatomethyl)-1,3,3-trimethylcyclohexane). The reaction mixture can also include monomeric diols and triols containing 3 to 16 carbon atoms, and the triols can provide non-terminal hydroxyl substituents that provide crosslinking of the polyurethane. For example, a polymeric polyol can be formed from a mixture of isophorone diisocyanate, a polytetramethylene glycol having a number average molecular weight of about 2900, 1,4-butanediol, and trimethylolpropane in a suitable molar ratio.

The noted reactions are generally promoted with a condensation catalyst such as an organotin compound including dibutyltin dilaurate. The polyurethane having terminal reactive alkoxysilane moieties, is further reacted (acid catalyzed) with a tetraalkoxysilane compound to provide a ceramer useful in the present invention. The molar ratio of aliphatic polyol:alkoxysilane-substituted alkyl isocyanate is generally from about 4:1 to about 1:4, or from about 2:1 to about 1:2.

Further details about useful aliphatic hydroxyl-terminated polyols and alkoxy-substituted alkyl isocyanate compounds are described in U.S. Pat. No. 5,968,656 (noted above). This patent also shows a general network of the ceramer (Col. 5-6).

The fluorinated polyurethane ceramer coatings described herein are advantageous because they have a low surface energy characteristic from a fluorinated moiety incorporated into the polyurethane with the durability imparted by the inorganic phase of the ceramer. Other advantages are low coefficient of friction, nonflammability, low dielectric constant, and high solvent and chemical resistance. Fluorinated ethers were incorporated into polyurethanes as described in U.S. Pat. No. 4,094,911 (Mitsch et al.).

The fluorinated polyurethane ceramer generally comprises the reaction product of a fluorinated polyurethane silicate hybrid organic-inorganic network formed as a reaction product of a fluorinated polyurethane having terminal reactive alkoxysilane moieties with a tetraalkoxysilane compound, and can be prepared by incorporating fluorinated ethers into the polyurethane backbone before it is end-capped with the isocyanatopropyltrialkoxysilane in the preparation of a polyurethane silicate hybrid organic-inorganic network as described in U.S. Pat. No. 5,968,656 (noted above) as illustrated in Scheme 1 below. In such embodiments, the polyurethane with terminal alkoxysilane groups is the reaction product of one or more fluorinated aliphatic polyols having terminal hydroxyl groups, at least one comprising a fluorinated polyol as further discussed below, optionally one or more non-fluorinated aliphatic polyols having terminal hydroxyl groups, and an alkoxysilane-substituted alkyl isocyanate compound. Suitable aliphatic polyols typically have molecular weights of at least 60 and up to and including 8000 and can be polymeric. Polymeric aliphatic polyols can further include a plurality of functional moieties such as an ester, ether, urethane, non-terminal hydroxyl, or combinations thereof. Polymeric polyols containing ether functions can be polytetramethylene glycols having number-average molecular weights at least 200 and up to and including 6500, which can be obtained from various commercial sources. For example, Terathane™-2900, -2000, -1000, and -650 polytetramethylene glycols having the indicated number-average molecular weights are available from Invista.

Polymeric polyols containing a plurality of urethane and ether groups can be obtained by reaction of fluorinated polyols and non-fluorinated polyols (such as polyethylene glycols) with alkylene diisocyanate compounds containing about 4 to 16 aliphatic carbon atoms, for example, 1,4-diisocyanatobutane, 1,6-diisocyanatohexane, 1,12-diisocyanatododecane, and, preferably, isophorone diisocyanate (5-isocyanato-1-(isocyanatomethyl)-1,3,3-trimethylcyclohexane). The reaction mixture can further include monomeric diols and triols containing 3 to about 16 carbon atoms as the triol compounds provide non-terminal hydroxyl substituents that provide branching of the polyurethane. In some embodiments, a polymeric polyol is formed from a mixture of isophorone diisocyanate, a polytetramethylene glycol having a number-average molecular weight of about 650, a fluoroalkoxy substituted polyether polyol having a number-average molecular weight of about 6300, 1,4-butanediol, and trimethylolpropane in a molar ratio of about 9:3:0.1:5:1.

Reaction of the aliphatic polyol having terminal hydroxyl groups with an alkoxysilane-substituted alkyl isocyanate compound, which can be promoted by a condensation catalyst, for example, an organotin compound such as dibutyltin dilaurate, provides a polyurethane having terminal reactive alkoxysilane moieties, which undergoes further reaction, such as an acid-catalyzed reaction, with a tetraalkoxysilane compound to provide a useful fluoroceramer. The molar ratio of aliphatic polyol:alkoxysilane-substituted alkyl isocyanate can be from 4:1 to 1:4 or more typically from 2:1 to 1:2.

Aliphatic hydroxyl-terminated polyols used in the preparation of the fluoroceramers can be of the general formula $$HO—R^1—OH$$

and can have molecular weights of at least 60 and up to and including 8000. As previously noted, at least one polyol is usually polymeric, and $R^1$ can include a plurality of ester, ether, urethane, and non-terminal hydroxyl groups.

The alkoxysilane-substituted alkyl isocyanate compound generally has the formula $$OCN—R^2—Si(OR^3)Z^1Z^2$$

wherein $R^2$ is an alkylene group having from 2 to 8 carbon atoms, $OR^3$ is an alkoxy group having 1 to 6 carbon atoms, and $Z^1$ and $Z^2$ are independently alkoxy groups having 1 to 6 carbon atoms, hydrogen, halo, or hydroxyl groups. More typically, $R^2$ has 2 to 4 carbon atoms, and $OR^3$, $Z^1$, and $Z^2$ are each alkoxy groups having 1 to 4 carbon atoms. A useful alkoxysilane-substituted alkyl isocyanate compound is 3-isocyanatopropyl-triethoxysilane.

Tetraalkoxysilanes act as crosslinkers for the trialkoxysilane-functionalized urethanes and fluorourethanes and also form filler particles of silicon suboxide, $SiO_x$. The tetraalkoxysilane compound can be tetramethyl orthosilicate, tetrabutyl orthosilicate, tetrapropyl orthosilicate, or more typically, tetraethyl orthosilicate ("TEOS").

The hybrid organic-inorganic network of the fluoroceramer used in such fluoroceramer embodiment the outermost surface layer of the cleaning blade member has the general structure as illustrated in Col. 5 of U.S. Pat. No. 5,968,656 wherein $R^1$ and $R^2$ are as previously defined, with the proviso that at least a portion of the $R^1$ groups include a fluorinated moiety. The hybrid organic-inorganic network includes at least 10 weight % and up to and including 80 weight % and more typically at least 25 weight % and up to and including 65 weight %. The fluorinated moiety in such ceramer can be conveniently obtained wherein the aliphatic hydroxyl-terminated polyol (such as a polyether diol) employed in formation of a non-fluorinated ceramer is partially replaced with the fluorinated ether to incorporate the low surface energy component into the polymer backbone. Full replacement of the aliphatic hydroxyl-terminated polyol with the fluorinated diol is generally not desirable as the surface properties do not change a great deal after the fluoropolymer accounts for more than about 20 weight % of the end capped polymer, also known as the "masterbatch."

A number of fluoroethers are available commercially that are suitable for use in this invention. In general the dihydroxy terminated fluoroalcohols are desired because they can be polymerized directly into the urethane polymer. The use of monohydroxyfluoroalcohols is not desirable because the end groups of the ceramer masterbatch should ideally contain trialkoxysilane functionality for subsequent reaction with the sol-gel precursors. The monomers should generally be diols or triols.

One class of macromers with a perfluoropolyethere chain backbone and diol end groups is Fluorolink D10 and D10-H available from Solvay Solexis in Italy. The same fluorocarbon structure but with the hydroxy end groups attached to ethylene oxide repeat units is also available from the same vendor as Fluorolink E10-H. These macromers are between 500-700 average equivalent weights.

$$HO—CH_2—CF_2—O—(CF_2—CF_2—O)_p—(CF_2—O)_q—CF_2—CH_2—OH$$

Fluorolink D10 and D10-H $$HO—(CH_2—CH_2—O)_n—CH_2—CF_2—O—(CF_2—CF_2—O)_p—(CF_2—O)_q—CF_2—CH_2—(O—CH_2—CH_2)_n—OH$$

Fluorolink E10 and E10-H

Generally higher molecular weights are desired to improve the mechanical properties of the urethane, such as ZDOLTX from Ausimont, Bussi, Italy with a number average molecular weight of 2300 and polydispersity of 1.6. Incorporation of these fluorinated blocks into polyurethanes can improve the chemical resistance and lower the coefficients of friction of thermoplastics with fluorine rich surfaces on materials with low fluorine content.

The dihydroxyfluoroethers are described in a report from the Department of Energy DOE/BC/15108-1 (OSTI ID: 750873) Novel $CO_2$-Thickeners for Improved Mobility Control Quarterly Report Oct. 1, 1998-Dec. 31, 1998 by Robert M. Enick and Eric J. Beckman from the University of Pittsburgh and Andrew Hamilton of Yale University, published February 2000 (http://www.osti.gov/bridge/servlets/purl/750873 KDMj2Z/webviewable/750873.pdf). Also described is the commercially available difunctional isocyanate terminated fluorinated ether Ausimont Fluorolink B. This urethane precursor has an average molecular weight of 3000 g/mol and a structure:

$$OCN—Ar—OCCF_2O(R^1)p(R^2)qCF_2CONH—Ar—NCO.$$

In these structures, $R^1$ is $CF_2CF_2O$, $R^2$ is $CF_2O$, and Ar is an aromatic group. In both fluorinated macromonomers, the difunctional contents are greater than 95% as characterized by NMR analysis. Ausimont describes both compounds as polydisperse.

Similar fluoroethers are also available from Aldrich Chemical (Milwaukee, Wis.) including multifunctional blocks. Such compounds include:

Poly(tetrafluoroethylene oxide-co-difluoromethylene oxide) α,ω-diol, $HOCH_2CF_2O(CF_2CF_2O)_x(CF_2O)_yCF_2CH_2OH$, average $M_n \approx 3800$;

Poly(tetrafluoroethylene oxide-co-difluoromethylene oxide) α,ω-diol bis(2,3-dihydroxypropyl ether), $HOCH_2CH(OH)CH_2OCH_2CF_2O(CF_2CF_2O)_x(CF_2O)_yCF_2CH_2OCH_2CH(OH)CH_2OH$, average $M_n \approx 2000$;

Poly(tetrafluoroethylene oxide-co-difluoromethylene oxide) α,ω-diol, ethoxylated $HO(CH_2CH_2O)_xCH_2CF_2O(CF_2CF_2O)_y(CF_2O)_zCF_2CH_2(OCH2CH_2)_xOH$, average $M_n \approx 2200$; and Poly(tetrafluoroethylene oxide-co-difluoromethylene oxide) α,ω-diisocyanate, $CH_3C_6H_3(NCO)NHCO_2(CF_2CF_2O)_x(CF_2O)_yCONHC_6H_3(NCO)CH_3$, average $M_n \approx 3000$.

Also suitable are PolyFox® Fluorochemicals from OMNOVA Solution Inc. (Fairlawn, Ohio) having the following structures:

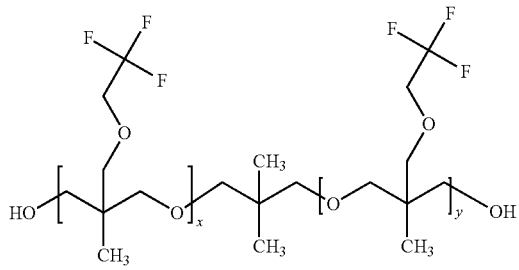

PolyFox PF-636 x + y = 6
PolyFox PF-6320 x + y = 20

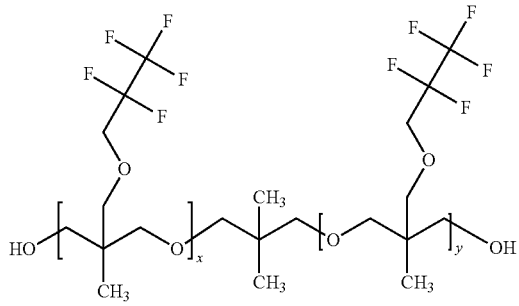

PolyFox PF-656 x + y = 6
PolyFox PF-6520 x + y = 20

These materials are thought to be more environmentally friendly than other fluorocarbons because these have only short fluorocarbon side chains.

The incorporation of the fluoromonomer can be represented as shown below in Scheme

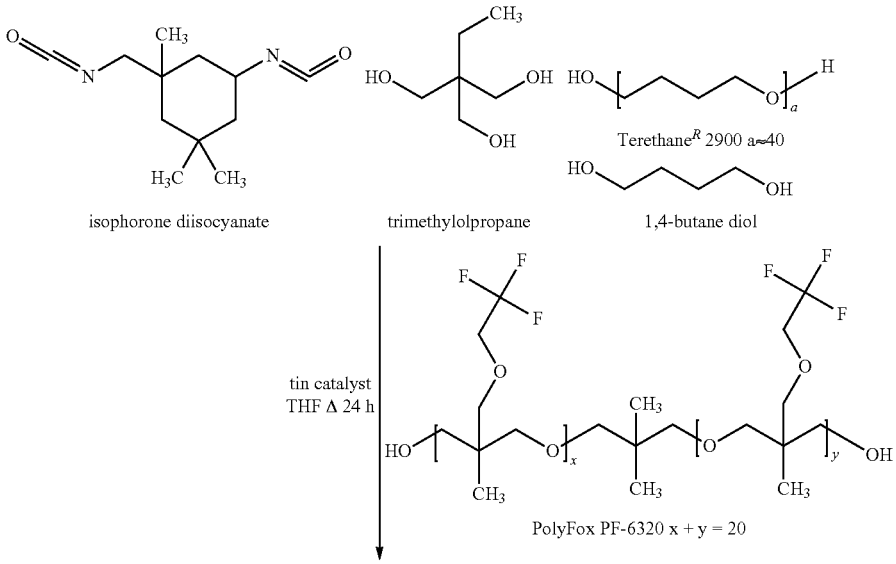

-continued

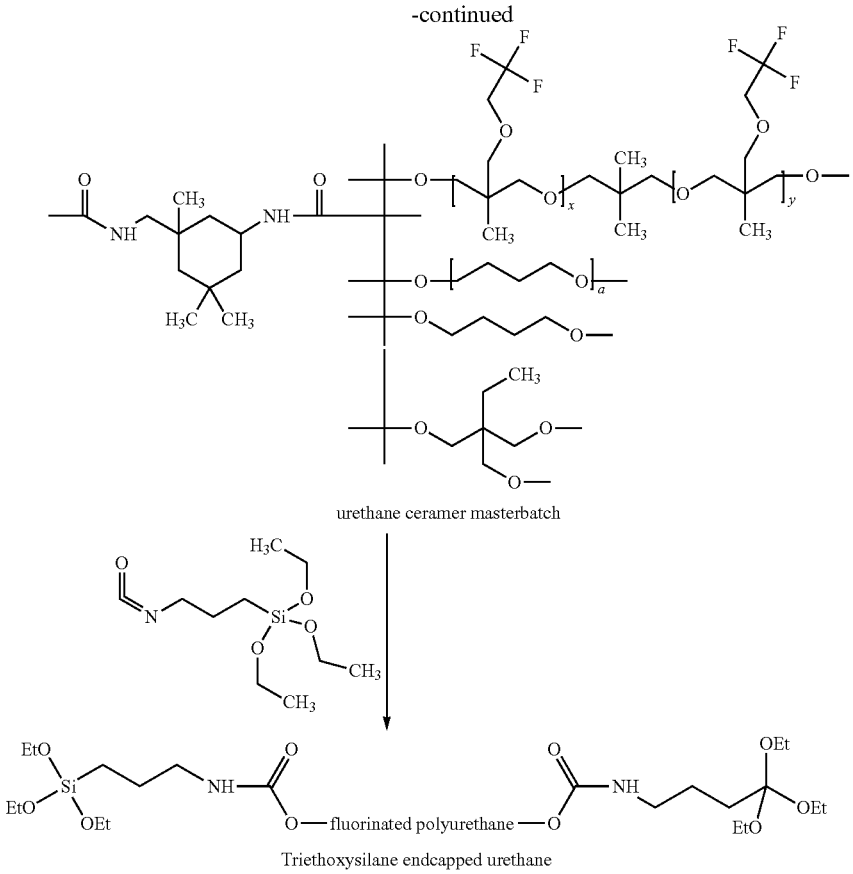

In the Examples described below, the triethoxysilane endcapped fluorinated polyurethane was allowed to react with tetraethoxyorthosilicate (TEOS) in the presence of acid and water to hydrolyze and condense the siloxane into a silsesquioxane network. These materials were coated on nickelized PET and cured overnight at 80° C. to form a polyurethane silicate hybrid organic-inorganic network.

Trialkoxyfluorosilanes can also be used to introduce fluorinated alkyl groups into the fluoroceramer. The carbon-silicon bond is stable in both acid and base. These bonds are unlike the hydrolyzable silicon-oxygen of the silicon alkoxides that cleave and form the condensation products of the fluoroceramer. Thus, in the same way, the end capped fluorourethane will be incorporated into the fluoroceramer product, so too will be the fluoroalkyl moiety that is part of an alkyltrialkoxysilane. Many silanes are available commercially including nonafluorohexyltriethoxysilane, nonafluorohexyltrimethoxysilane, (heptadecafluoro-1,1,2,2-tetrahydrodecyl)triethoxysilane, and (heptadecafluoro-1,1,2,2-tetrahydrodecyl)trimethoxysilane. Additionally, more reactive groups can be used in place of the alkoxy groups. For example, both chloro and amino groups will hydrolyze from the silicon atom in the presence of alcohol or water. An example of the fluoroalkylsilane with hydrolysable chloro functionality is (heptadecafluoro-1,1,2,2-tetrahydrodecyl) trichlorosilane. The condensation of trihydroxy-substituted silicon atoms that contain an alkyl group are known as silsesquioxanes, and are sometimes represented by the formula $RSiO_{1.5}$, which would describe the product of the derivatized fluorinated urethane if TEOS is replaced with the trialkoxysilane. Mixing TEOS with the fluorinated trialkoxysilane would produce a material somewhere between a silsesquioxane and a ceramer. Additionally, a certain level of di- or monohydrolysable fluoroalkylsilane can be used to incorporate fluorinated groups into the fluoroceramer. These include heneicosafluorododecyltrichlorosilane and (heptadecafluoro-1,1,2,2-tetrahydrodecyl)methyldichlorosilane.

The ceramer or fluoroceramer comprises at least 10 weight % and up to and including 95 weight %, or typically at least 60 weight % and up to and including 80 weight %, of the outermost surface layer. Mixtures of either or both ceramers and fluoroceramers can be used if desired.

Second Materials

To control the extent of any tribocharging caused by cleaning surface layer 142, second materials comprising nanosized inorganic particles are distributed within the outermost surface layer 242. By "nanosized", we mean the particles have an average largest dimension of at least 1 nm and up to and including 500 nm, or typically of at least 10 nm and up to and including 100 nm so that the particles disrupt the surface to a very limited extent (little effect on surface roughness), for example when the outermost surface layer has an average thickness of less than 10 μm. The small nanosized inorganic particles also provide clear coatings that are relatively transparent to light that can be an advantage for densitometry readings of toner particles on the intermediate transfer member. These particles can be present in any desirable size and shape but generally, they are essentially spherical. However, elongated, acircular, plate-like, or needle-like particles are also useful. The average particle size can be determined by light scattering and electron microscopy.

Particularly useful inorganic particles are metal oxides such as alumina or silica particles, for example spherical silica or alumina particles. Mixtures of alumina and silica particles can be used if desired. In some embodiments, the inorganic particles are triboelectrically charging metal oxide particles. Useful inorganic particles can be readily obtained from several commercial sources. Silica particles that are not agglomerated to large secondary particles are available in solvents such as water, various alcohols, and methyl ethyl ketone (MEK) that is also known as 2-butanone. These particles are available from Nissan Chemical of America in Texas as ORGANOSILICASOL™ colloidal silica mono-dispersed in organic solvent.

Dispersions of agglomerated alumina can also be prepared from dry powders such as gamma-alumina. These agglomerates can be broken down into nanosized inorganic particles that are stable in different solvents using various types of milling to achieve different particle sizes, including ball milling and media milling. High quality gamma-alumina powders that can be milled into stable, translucent dispersions are available from Sasol of America in Houston, Tex.

The nanosized inorganic particles are generally present in the outermost surface layer in an amount of at least 5 weight % and up to and including 50 weight % of the total solids of the outermost surface layer. More likely, the nanosized inorganic particles are present in an amount of at least 10 weight % and up to and including 40 weight % of the outermost surface layer.

Silica has a positive charge under all pH conditions, even under the acidic conditions that can be used in preparing the urethane ceramer. Thus, it can be expected that the addition of nano-sized inorganic silica particles in a cleaning surface 242 would negatively charge outer surface 308. Further, it can be expected that a negatively charged toner particle would not adhere to a cleaning blade having a cleaning surface layer 242 and that the cleaning effectiveness of such a cleaning blade can be enhanced by the additional electrostatic repulsion between contact surface 242 and such toner.

In contrast, Alumina carries a negative charge under the acidic conditions that are used to make ceramer and fluoroceramer coatings. Thus, it can be expected that the addition of nano-sized inorganic silica particles in a cleaning surface layer 242 would positively charge outer surface 308. Further, it can be expected that a negatively charged toner particle would adhere to a cleaning blade having a cleaning surface layer 242 and that the cleaning effectiveness of such a cleaning blade can be impaired by the burden of a mass of toner attracted to contact cleaning surface layer 242. Accordingly, careful selection of nano-sized particles for use with a ceramer or a fluoroceramer can significantly impact cleaning blade performance as well the performance of the composite photoreceptive imaging member 114.

In application, it will be understood that the performance requirements of the composite photoreceptive imaging member 114 are critical to good performance. Accordingly, it can be highly advantageous to have a wide range of design freedom with respect to cleaning blade 140 so that cleaning blade 140 can be provided in a manner that does not require compromises in the selection of materials or the design of composite photoreceptive imaging member 114. This requires that cleaning blade member 230 has a cleaning surface layer 242 that has the design flexibility to be customized so that it can meet the design In one embodiment this need is met by providing a cleaning blade member 230 with a cleaning surface layer 242 that has a first material and a second material that are combined in proportions that cause a triboelectric charge to be formed on the outer surface 308 having a difference of potential of between zero and minus 20 volts to be generated between the outer surface 308 and a ground 314. It will be appreciated for example, that in a case where the second material is charged more strongly than the first material, the proportion of second material in cleaning surface layer 242 relative to the proportion of a first material in cleaning surface layer 242 can significantly influence the extent to which cleaning surface layer 242 will charge outer surface 208. Thus, it becomes possible to control the extent to which cleaning surface layer 242 will charge outer surface 208 by controlling proportions of the first material and the second material in cleaning surface layer 242. Such control is also possible where there is a less substantial difference between the charging effects of the first material and the second material, and in such a smaller range of variation of control is possible, however more refined control of the charging effects of the cleaning surface layer can be possible.

In another embodiment, the second material can comprise a combination of a material comprising a silica and a material comprising an alumina in a ratio that that limits the extent of the charge on the receiver. As is discussed above, silica carries a strong positive charge while the alumina provides a strong negative charge. By using a silica material and an alumina material in combination to form a second material, it is possible to define charging characteristics of the second material in a manner within a wide range of possible outcomes depending on the ratio of the material comprising silica and the material comprising alumina. It will be appreciated that, in other embodiments both the proportion of the first material and the second material and a ratio of materials in the second material can be used to achieve desired charge levels.

As is noted above, it can also be useful to control friction between cleaning surface member and composite photoreceptive imaging member 114. In the cleaning blade member 230 this can be done in part by using a first material that is determined to provide a lower coefficient of friction between the first material and the outer surface than between the second material and the outer surface and wherein the proportions of the first material and the second material in the second cleaning surface layer to provide a determined coefficient of friction between the cleaning surface layer and the outer surface while also providing a determined range of triboelectric charging.

As noted above, the cleaning blade member 230 can be incorporated into a suitable apparatus that can be used for electrostatic or electrostatographic imaging, and used for the intended purpose described above.

Besides the specific apparatus described in FIG. 1, more generally, such an apparatus for providing an electrostatographic image includes at least a toner-image forming unit that uses a developer containing a toner to form a toner image on a toner image carrier (such as a photoconductor), and the intermediate transfer member (drum or web). Other components or stations are often present as one skilled in the art would readily understand. Representative apparatus in which the cleaning blade member 230 of this invention can be incorporated are described for example, in U.S. Pat. Nos. 5,666,193 (Rimai et al.), 5,689,787 (Tombs et al.), 5,985,419 (Schlueter, Jr. et al.), 5,714,288 (Vreeland et al.), 6,548,154 (Stanton et al.), 6,694,120 (Ishii), 7,728,858 (Hara et al.), and 7,729,650 (Tamaki), U.S. Patent Application Publications 2004/0247347 (Kuramoto et al.), 2009/0250842 (Okano), 2009/0074478 (Kurachi), and 2009/0074480 (Suzuki), and EP 0 747 785 (Kusaba et al.), all incorporated herein by reference to show apparatus features.

For example, the toner-image forming unit can have a charging device that produces electric charge on the toner image carrier, an exposure device that forms an electrostatic latent image on the image carrier, and a developing device that develops the electrostatic latent image with the developer containing the toner to form a toner image.

In addition, the apparatus can further comprise a receiver element device that can hold receiver elements (such as sheets of paper) to which the toner image can be transferred from the intermediate transfer member. The intermediate transfer member in this apparatus can be an endless belt.

Further, the apparatus can further comprise a fixing unit for fixing the toner image on a receiver element.

In simple terms, a toner image on a receiver element can be formed by:

forming an electrostatic latent image on an image carrier, developing the latent image with a dry developer comprising toner particles to form a toner image, transferring the toner image to an intermediate transfer member (for example an endless belt), and transferring the toner image from the intermediate transfer member to a receiver element in the presence of an electric field that urges the movement of the toner image to the receiver element.

Dry developers are well known in the art and typically include carrier particles and toner particles containing a desired pigment.

This method can further comprise fixing the toner image on the receiver element.

The cleaning blade member 230 described herein can have at least the following embodiments and combinations thereof, but other combinations of features are considered to be within the present invention as a skilled artisan would appreciate from the teaching of this disclosure:

1. A cleaning blade member 230 comprising:

a polymer substrate 240, and disposed upon the polymer substrate, an cleaning surface layer 242 consisting essentially of a non-particulate, non-elastomeric ceramer or fluoroceramer and nanosized inorganic particles that are distributed within the non-particulate ceramer or fluoroceramer in an amount of at least 5 weight % and up to and including 50 weight % of the outermost surface layer.

2. The cleaning blade member 230 of embodiment 1 wherein the inorganic particles have an average largest dimension of at least 1 nm and up to 500 nm.

3. The cleaning blade member 230 of embodiment 1 or 2 wherein the inorganic particles have an average largest dimension of at least 10 nm and up to and including 100 nm.

4. The cleaning blade member 230 of any of embodiments 1 to 3 wherein the inorganic particles are silica or alumina particles.

5. The cleaning blade member 230 of any of embodiments 1 to 4 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound.

6. The cleaning blade member of embodiment 5 wherein the ceramer polyurethane having terminal alkoxysilane groups comprises the reaction product of one or more aliphatic non-fluorinated polyols having terminal hydroxyl groups and an alkoxysilane alkyl-substituted isocyanate compound, and the fluoroceramer polyurethane having terminal alkoxysilane groups comprises the reaction product of one or more fluorinated aliphatic polyols having terminal hydroxyl groups, one or more non-fluorinated aliphatic polyols having terminal hydroxyl groups, and an alkoxysilane alkyl-substituted isocyanate compound.

7. The cleaning blade member of any of embodiments 1 to 6 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound, wherein the tetraalkoxysilane compound is tetramethyl orthosilicate, tetrabutyl orthosilicate, tetrapropyl orthosilicate, or tetraethyl orthosilicate.

8. The cleaning blade member of any of embodiments 1 to 7 wherein the ceramer comprises a polyurethane silicate hybrid organic-inorganic network formed as a reaction product of a non-fluorinated polyurethane having terminal reactive alkoxysilane groups with tetraethyl orthosilicate, and the fluoroceramer comprises a fluorinated polyurethane silicate hybrid organic-inorganic network formed as a reaction product of a fluorinated polyurethane having terminal reactive alkoxysilane groups with tetraethyl orthosilicate.

9. The cleaning blade member of any of embodiments 1 to 8 wherein the outermost layer has a thickness of at least 1 μm and up to and including 20 μm.

10. The cleaning blade member of any of embodiments 1 to 9 wherein the outermost layer has a thickness of at least 3 μm and up to and including 12 μm.

11. The cleaning blade member of any of embodiments 1 to 10 wherein the outermost layer comprises a silicon oxide network comprising at least 10 weight % and up to and including 80 weight % of the non-particulate ceramer or fluoroceramer.

12. The cleaning blade member of any of embodiments 1 to 11 wherein the outermost layer has a static or dynamic (kinetic) coefficient of friction less than 0.5.

13. The cleaning blade member of any of embodiments 1 to 12 wherein the outermost layer is transparent.

14. The cleaning blade member of any of embodiments 1 to 13 wherein the polymer substrate comprises a polyurethane.

15. The cleaning blade member of any of embodiments 1 to 14 wherein the outermost layer has a storage modulus of at least 0.1 GPa and up to and including 2 GPa.

16. An electrostatic apparatus comprising:

a toner-carrying member, and the cleaning blade member of any of embodiments 1 to 15 that is capable of cleaning the toner-carrying member.

17. The apparatus of embodiment 16 wherein the toner-carrying member is a photoconductor or an intermediate transfer member.

18. The apparatus of embodiment 16 or 17 further comprising a charging device that produces electric charge on a toner image carrier, an exposure device that forms an electrostatic latent image on the toner image carrier, and a developing device that develops the electrostatic latent image with a developer containing the toner to form a toner image.

19. The apparatus of embodiment 18 that further comprises a receiver element device that can hold toner receiver elements to which a toner image can be transferred from an intermediate transfer member.

20. The apparatus of embodiment 18 or 19 further comprising a fixing unit for fixing the toner image on one or more toner receiver elements.

The following Examples are provided to illustrate the practice of this invention and are not meant to be limiting in any manner.

Preparation of Ceramer and Fluoroceramer Solutions:

10 Weight % Fluoroceramer Masterbatch:

To a 500 ml, three-neck round bottom flask containing dry tetrahydrofuran (THF) (150 ml) under nitrogen were added Terathane™ 650 polytetramethylene glycol (19.45 g, 0.030 mol), 1,4-butanediol (4.25 g, 0.047 mol), Polyfox® PF-6320 surfactant (5.36 g, 0.0014 mol), and trimethylolpropane (1.30 g, 0.010 mol). The resulting mixture was stirred under nitrogen until a solution was obtained and then isophorone diisocyanate (19.64 g, 0.088 mol) was added, and the mixture was degassed under reduced pressure (0.1 mm Hg). Dibutyltin dilaurate (0.10 g, 0.0002 mol) was added, and the resulting mixture was heated at 60° C. under nitrogen for 5 hours. To this solution, were added 3-isocyanatopropyltriethoxysilane (4.04 g, 0.0081 mol) and additional THF (35 ml). The mixture was heated at 60° C. for 15 hours, yielding a solution containing 24 weight % dissolved solids.

Invention Example 1

10 Weight % Fluorinated Ceramer with 1.47 TEOS/Polymer and 0.67 MEK-ST Silica/TEOS In a glass jar, to a stirred solution of ORGANOSILICASOL™ MEK-ST (19.86 g), isopropyl alcohol (19 ml), and 0.15 N triflic acid (3.42 ml) was added the 10 weight % Fluoroceramer Masterbatch (25.0 g) that had been previously diluted with isopropanol (IPA) (20 ml). Additional IPA (60 ml) was added slowly to achieve a clear solution of the fluoroceramer containing the silica particles, followed by dropwise addition of tetraethoxyorthosilicate (TEOS, 8.83 g, 0.039 mol). The solution was then stirred at room temperature for 48 hours, after which Silwet® L-7001 (0.88 g of a 10 weight % solution in IPA) was added. The solution was stirred overnight and diluted with 62 g of addition IPA to 8 weight % solids before coating onto polyurethane blades.

The polyurethane cleaning blade member substrates were spray coated with this solution using a Preval™ lab sprayer or coated with a brush. The coatings were cured by placing the cleaning blade members in an oven and increasing the temperature to 80° C. over 1 hour and maintaining the temperature for 24 hours. Alternatively, a ring-coater was used to pull a polyurethane slab (for example, 380 mm×25 mm×1.9 mm) through a gasket that had the fluoroceramer coating solution sitting on top of it. The coating was cured as described above and attached to a metal housing to form a fluoroceramer coated polyurethane cleaning blade member 230.

These fluoroceramer coated cleaning blade members were analyzed for coefficient of friction. A 6.5 cm in length strip of coated elastomer was attached to the bottom of a 200 g weighted sled using double sided plastic adhesive tape. The sled was pulled over a sheet of photoconductor that had been placed on a vacuum platen. A load cell was used to measure the force needed to move the fluoroceramer coating against the photoconductor, the results were recorded using a computer, and the static and dynamic coefficients of friction were calculated. A graph was generated during these experiments to eliminate samples where the sled 200 g weight would leap or jump because of a stick-slip type of friction. The fluoroceramer coated wiper blade of this invention was found to have a static coefficient of friction of 0.5 and a kinetic coefficient of friction of 0.4. In contrast, the uncoated polyurethane elastomer stuck to the photoconductor and the coefficient of friction could not be measured.

Invention Example 2 and Comparative Example 1

Cleaning Blade Members with and without Fluoroceramer Coating and with Toner on the Blade Versus Dry No Toner Wiper blades are defined as cleaning blade members in which the elastomer coating of the cleaning blade member bends in the same direction that the web moves. Wiper blades are described for example in U.S. Pat. No. 6,453,154. Wiper blades were prepared by coating a polyurethane substrate fluoroceramer-nanoparticle composition according to this invention using a brush for comparison with non-coated wiper blades. All of the wiper blades were then coated with toner particles to act as lubricants and were compared at starting angles of 80° and 85°. The starting angle was the angle that the wiper blade made with the surface to be cleaned under no load or no deformation.

PU: Polyester Polyurethane, 75 Shore A
thickness: 0.050 inch (1.27 mm)
free extension: 0.250 inch (6.35 mm)
blade starting angle: 80° or 85°
NexPress Image Cylinder diameter of 181.9 mm
Conditions: FLC: fluoroceramer (dry or toner coated edge), no Fluoroceramer coated (dry or toner coated)

Figure 18:
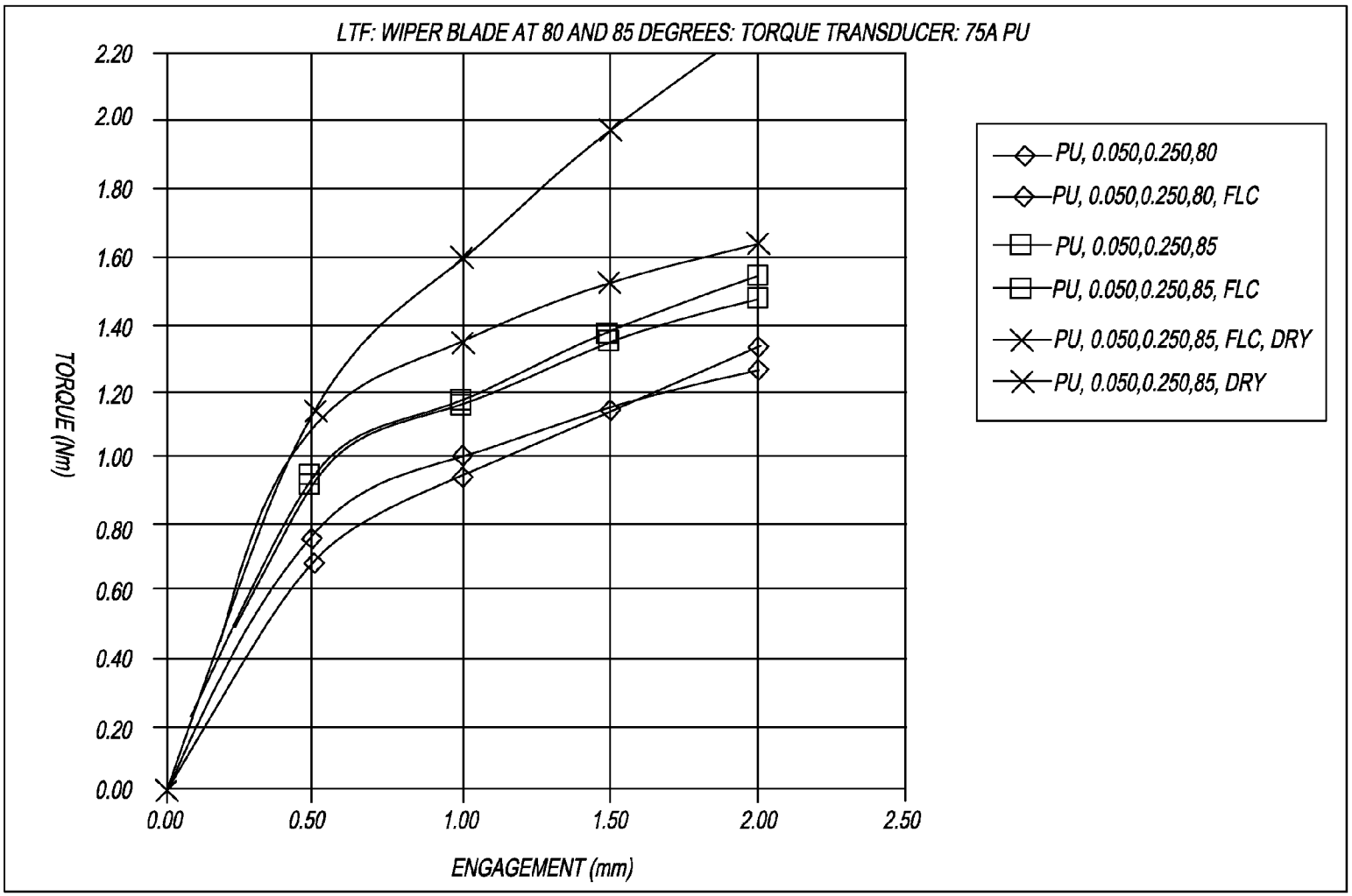
FIG. 18 is a graphical representation of data obtained in Invention Example 2 and Comparative Example 1 described below.

As shown in FIG. 18, there was little difference in the torque measured with either wiper blade coated with toner particles. At an angle of 80° the two wiper blades with toner particles show an increase in torque from about 0.75 Nm to about 1.28 Nm as the engagement of the wiper blade against the NexPress Imaging Cylinder was increased from 0.5 mm to 2.0 mm (two lower curves). An increase of the angle to 85° also yielded similar results for the two wiper blades coated with toner particles with the torque increasing from 0.9 Nm to 1.5 Nm as the engagement was increased from 0.5 to 2.0 mm (middle two curves). However, a substantial difference in performance was observed for the "dry" (DRY) blades that were not treated with toner particles or were wiped clean to remove toner particles from its surface (two top curves). Under these conditions, the wiper blades (cleaning blade members) of the present invention provided much lower torque than the clean, uncoated polyurethane cleaning blade member. The wiper blade that was mounted at 85° showed only a modest increase in torque over the wiper blades that were also coated with toner particles, going from 1.0 Nm to 1.6 Nm as the engagement was increased from 0.5 to 2.0 mm. Under the same conditions, the polyurethane wiper blade produced torque readings of 1.15 Nm to 2.0 Nm. The lower coefficient of friction of the wiper blades of this invention can provide improved cleaning performance, more wear resistance, and reduced sensitivity of the cleaning blade member torque load due to toner lubrication.

Invention Example 3

Cleaning Blade Members-Scraper Blades

An evaluation of scraper blades of this invention was carried out by coating a polyurethane slab from ZATEC (75 Shore A) with a composition used in the present invention (ring coated) to provide a scraper blade of this invention versus an uncoated scraper blade outside of this invention.

Each scraper blade thickness was 0.050 inch (1.27 mm) and the free extension was 12 mm. Each scraper blade was mounted to a NexPress Image Cylinder cleaner to make a starting angle with the Image Cylinder surface of 154° (or 26° when measured with a tangent through the cleaned surface) as illustrated below, and each scraper blade was coated with 6 μm toner particles. The uncoated scraper blade flipped or was inverted during the evaluation (even with the toner particle coating) and no torque measurement could be taken. The scraper blade of this invention was stable and the torque measurement was about 382 mm at an engagement of 1 mm when it was coated with the toner particles. The coating composition described for use in the practice of this invention allowed the scraper blades to be mounted at a lower ratio of dry thickness to free extension than is normally used in commercial applications and provides less sensitivity to toner lubrication. Other techniques for coating cleaning blade members with powders such as Kynar 301F, Teflon, and others can provide some of the benefits but those powders do not provide durable coatings on cleaning blade members and such cleaning blade members would "flip" in the scraper blade mode of operation.

The scraper blade of this invention was used in an electrostatographic apparatus and appeared to clean most of the toner particles left from transfer to an intermediate transfer member of a "blanket" cylinder.

The invention has been described in detail with particular reference to certain preferred embodiments thereof, but it will be understood that variations and modifications can be effected within the spirit and scope of the invention.

What is claimed is:

1. A cleaning system comprising:

a composite photoreceptive imaging member having a support layer, an electrically conductive layer interfacing with the support layer, a photoconductive charge generation layer interfacing with the electrically conductive layer and generating charge holes and electrons in response to exposure to electromagnetic radiation; a charge transport layer that allows charge holes to migrate from the charge generation layer to an outer surface of the imaging member while resisting migration of electrons from the charge generation layer to the outer surface; and a cleaning blade member having a cleaning surface layer against the outer surface to at least in part remove toner and debris from the outer surface;

wherein the cleaning surface layer has a first material and a second material that are combined in proportions that cause a triboelectric charge to be formed on the outer surface having a difference of potential of between zero and minus 20 volts to be generated between the outer surface and a ground.

2. The cleaning system of claim 1, wherein the second material comprises a material containing a silica.

3. The cleaning system of claim 1, wherein the second material comprises a combination of a material comprising a silica and a material comprising an alumina in a ratio that that controls the charging of the composite photoreceptive imaging member.

4. The cleaning system of claim 1, wherein there is a lower coefficient of friction between the first material and the outer surface than between the second material and the outer surface and wherein the proportions of the first material and the second material in the cleaning surface layer provide a determined coefficient of friction between the cleaning surface layer and the outer surface.

5. The cleaning system of claim 1, wherein the first material is one of a ceramer or a fluoroceramer.

6. The cleaning system of claim 1, wherein the outer surface does not conduct electricity.

7. The cleaning system of claim 1, wherein the outer surface is a surface at an interface between the charge transport layer and air.

8. The cleaning system of claim 1, wherein the cleaning surface layer comprises a urethane based ceramer having silica particles of a size between 10 and 300 nanometers.

9. The cleaning system of claim 1, wherein the cleaning surface layer comprises a urethane based fluoroceramer having silica particles of a size between 10 and 300 nanometers.

10. The cleaning system of claim 1, wherein the cleaning surface layer has coefficient of friction with respect to the composite photoreceptive imaging member of less than 0.5.

11. The cleaning system of claim 1, wherein the conductive layer comprises a portion of a conductive support layer.

12. A cleaning system comprising:

a photoconductive primary imaging member having a support layer, an electrically conductive layer interfacing with the support layer, a photoconductive charge generation layer generating charge holes and electrons in response to exposure to electromagnetic radiation; a charge transport layer between the electrically conductive layer and the photoconductive charge generation layer that allows holes to migrate from the charge generation layer to the electrically conductive layer while resisting migration of electrons from the charge generation layer to electrically conductive layer; and, a cleaning blade member having a cleaning surface layer in contact with an outer surface of the imaging member;

wherein the cleaning surface layer has a first material and a second material that are combined in proportions that cause a triboelectric charge to be formed on the outer surface having a difference of potential of between zero and plus 20 volts to be generated between the outer surface and a ground.

13. The cleaning system of claim 12, wherein the second material comprises a material containing alumina.

14. The cleaning system of claim 12, wherein the second material comprises a combination of a material comprising a silica and a material comprising an alumina in a ratio that controls charging the charging of the composite photoreceptive imaging member.

15. The cleaning system of claim 12, wherein there is a lower coefficient of friction between the first material and the outer surface than between the second material and the outer surface and wherein the proportions of the first material and the second material in the cleaning surface layer provide a determined coefficient of friction between the cleaning surface layer and the outer surface.

16. The cleaning system of claim 12, wherein the first material is one of a ceramer or a fluoroceramer.

17. The cleaning system of claim 12, wherein the outer surface does not conduct electricity.

18. The cleaning system of claim 12, wherein the outer surface is a surface at an interface between the charge generation layer and air.

19. The cleaning system of claim 12, wherein the cleaning surface layer comprises a urethane based ceramer having alumina particles of a size between 10 and 300 nanometers.

20. The cleaning system of claim 12, wherein the cleaning surface layer comprises a urethane based fluoroceramer having alumina particles of a size between 10 and 300 nanometers.

21. The cleaning system of claim 12, wherein the cleaning surface layer has coefficient of friction with respect to the composite photoreceptive imaging member of less than 0.5.

22. The cleaning system of claim 12, wherein the conductive layer comprises a portion of a conductive support layer.

23. The cleaning system of claim 12, wherein the cleaning surface layer has a second material with inorganic particles with an average largest dimension of at least 1 nanometer and up to and including 500 nanometers.

* * * * *